US006668151B2

(12) United States Patent
Uehara et al.

(10) Patent No.: US 6,668,151 B2
(45) Date of Patent: Dec. 23, 2003

(54) MAGNETIC CORE, MAGNETIC FIELD SHIELD MEMBER, AND ELECTROPHOTOGRAPHIC APPARATUS USING THEM

(75) Inventors: Yasuhiro Uehara, Ashigarakami-gun (JP); Kanji Oka, Ashigarakami-gun (JP); Shigehiko Haseba, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 135 days.

(21) Appl. No.: 10/083,549

(22) Filed: Feb. 27, 2002

(65) Prior Publication Data

US 2003/0020586 A1 Jan. 30, 2003

(30) Foreign Application Priority Data

Jul. 30, 2001 (JP) ..... 2001-230149
Nov. 30, 2001 (JP) ..... 2001-366402

(51) Int. Cl.[7] ..... G03G 15/20
(52) U.S. Cl. ..... 399/328; 219/216
(58) Field of Search ..... 399/328, 330, 399/320; 219/216

(56) References Cited

U.S. PATENT DOCUMENTS

2003/0044199 A1 * 3/2003 Funabashi ..... 399/176

FOREIGN PATENT DOCUMENTS

| | | |
|---|---|---|
| JP | 49-78559 | 7/1974 |
| JP | A 8-76620 | 3/1996 |
| JP | A 2000-188177 | 7/2000 |
| JP | A 2000-242108 | 9/2000 |
| JP | A 2000-268952 | 9/2000 |

* cited by examiner

*Primary Examiner*—Quana M. Grainger
(74) *Attorney, Agent, or Firm*—Oliff & Berridge, PLC

(57) ABSTRACT

There are provided (1) a magnetic coil in which magnetic particles 14 form an aggregate and the aggregate of the magnetic particles is disposed in a vessel 12 while the magnetic particles are keeping a particle state, (2) a magnetic field shield member for shielding magnetic field generated from a magnetic field generation member, the magnetic field shield member in which magnetic particles form an aggregate and the aggregate of the magnetic particles is disposed in a vessel 12 while the magnetic particles are keeping a particle state, and an electrophotographic apparatus using them.

28 Claims, 11 Drawing Sheets

MAGNETIC CORE, MAGNETIC FIELD SHIELD MEMBER, AND ELECTROPHOTOGRAPHIC APPARATUS USING THEM

The present disclosure relates to the subject matter contained in Japanese Patent Application No.2001-230149 filed on Jul. 30, 2001 and Japanese Patent Application No.2001-366402 filed on November 30, which are incorporated herein by reference in its entirety.

BACKGROUND OF THE INVENTION

1. Field of the Invention

This invention relates to a magnetic core, a magnetic field shield member, and an electrophotographic apparatus using them and in particular to a magnetic core suitably used for an inductance element such as a coil or a transformer with a magnetic substance installed to produce an electromagnetic characteristic, a magnetic field shield member, and an electrophotographic apparatus using them.

2. Description of the Related Art

A coil or a transformer of an inductance element is one of important parts of electronic machines and electric appliances as a part having inductance. In recent years, electronic machines such as mobile telephones, PHS, and portable computers have tended to be sophisticated, miniaturized, and manufactured at low costs, and high performance, miniaturization, and manufacturing at low costs have also been required for coils and transformers of parts used with the electronic machines.

Most of the size, performance, and cost of a coil or a transformer are determined by a magnetic core used with the coil or the transformer. If a material having large effective magnetic permeability is used as a magnetic core material, the self-inductance and mutual inductance of the coil or the transformer can be increased and parts can be miniaturized. In the coil or the transformer, the loss quantity as represented by the Q value of inductance is a parameter directly involved in the energy efficiency of the coil or the transformer, and the coil or the transformer having a large Q value, namely, a small loss quantity is assumed to be have good performance.

Hitherto, a silicon steel plate and a ferrite sintered compact have been used as magnetic core materials of coils and transformers. Since a metal material such as a silicon steel plate has large conductivity generally, if the metal material is localized in a changing magnetic flux, an eddy current occurs and heat is generated, namely, so-called eddy-current loss occurs. Thus, to use a metal material as a magnetic core, the magnetic core is formed as a structure of stacking several silicon steel plates each formed of thin metal material, thereby preventing the eddy-current loss.

With such silicon steel plate, the loss increases in a high-frequency band. Thus, in the high-frequency band, a ferrite sintered substance of a metal oxide material is used in place of the silicon steel plate.

However, the ferrite sintered substance has the disadvantages that it is not easy to work to any desired shape, that it is also poor in flexibility, and that it is at high cost. Then, use of a composite material comprising ferrite particles dispersed in resin has been proposed. The composite material can be provided as a material which is flexible and is also comparatively small in loss, but has small magnetic permeability and thus is not satisfactory as a magnetic core material.

As the magnetic core of a coil or a transformer, a plurality of portions, such as an E-shaped core and an I-shaped core, may be joined to form one magnetic core. In this case, if only a minute gap exists, it is comparable to the fact that magnetic circuit is largely cut. As the gap exists, the magnetic characteristic of the magnetic core is made worse and a magnetic field leakage occurs, causing an unnecessary electromagnetic field leakage to occur. A coil or a transformer is installed in various electric appliances; in recent years, when designing various electric appliances, it has become necessary to consider the effect of the magnetic flux leaked from such an electric appliance on a human body.

By the way, as image formation technology, electrophotography has become widespread because it provides many merits of high print speed, convenience of eliminating the need for providing a print plate each time, capability of providing images directly from various pieces of image information, comparatively small-sized apparatus, easiness to provide a full-color image, and the like.

An image formation apparatus (electrophotographic apparatus) adopting electrophotography generally forms an electrostatic latent image on the surface of a latent image receptor, brings charged toner into contact with the surface of the latent image receptor to selectively deposite the toner to form a toner image, and transfers the toner image to a record medium via or not via an intermediate transfer body and then fixes the toner on the surface of the record medium by heat and/or pressure, etc., thereby providing an image.

In such an electrophotographic apparatus, usually a fuser comprising a heating roll and a pressurizing roll abutting each other is used for fixing. A record medium on which an unfixed toner image is formed is inserted into a nip part formed by the heating roll and the pressurizing roll abutting each other, whereby the toner is fused by heat and pressure and is fixed on the record medium as a permanent image. A heating member, a pressurizing member shaped like an endless belt may be used in place of the heating roll and/or the pressurizing roll. The heating roll comprises a metal core containing a heat source such as a halogen lamp, the metal core being formed with an elastic layer and a release layer, and the heating roll surface is heated internally by the heat source.

In the fuser, it is desired to instantaneously heat the heating member of the heating roll, etc., and lessen the wait time (warm-up time) as much as possible from the viewpoint of energy saving and the viewpoint of preventing the user from waiting when using the image formation apparatus. However, with the fuser adopting a heating roll containing a heat source such as a halogen lamp, there is a limit to shortening the warm-up time for the reasons that it takes a considerable time in heating the halogen lamp itself, that it takes a time until heat propagates to the surface because heat is generated from the inside of the heating roll, that it takes a time in heating the whole because a heating roll core having a considerable heat capacity must be selected, and the like. If a halogen lamp is used as the heat source, so-called flicker phenomenon occurs in which an energization current flows transiently when the halogen lamp is turned on or off; this is also a problem.

In recent years, as a heating section used in the fuser, section using an electromagnetic induction heating technique has been studied in place of the heat source such as a halogen lamp (JP-A-2000-242108). In the technique, a magnetic field generated by a magnetic field generation section is made to act on a heating member having a conductive layer, whereby the heating member is heated by the electromagnetic induction action; the flicker problem is not involved and only the heated object can be heated instantaneously, so that the warm-up time can be shortened.

The electromagnetic induction heating technique can be applied to any of a roll-shaped member such as a heating roll or a pressurizing roll or a member shaped like an endless belt replacing either or both of the heating roll and the pressurizing roll as the heating member. With the roll-shaped member, only the vicinity of the surface contributing to fixing may be heated and the core need not be heated, so that energy saving can be accomplished. On the other hand, the member shaped like an endless belt is thin and thus has a small heat capacity and can accomplish energy saving of a still higher order.

The electrophotographic apparatus may adopt not only the technique of fixing a record medium to which an unfixed toner image is transferred from a latent image receptor or an intermediate transfer body by a separate fuser as described above (which will be hereinafter simply referred to as "transfer and fixing independent technique" in some cases), but also a transfer and fixing simultaneous technique of bringing the unfixed toner image formed on an intermediate transfer body into contact with a record medium while heating, and applying pressure, thereby performing transfer and fixing at the same time (JP-A-49-78559, etc.,). In the transfer and fixing simultaneous technique, adopting the electromagnetic induction heating technique in transferring and fixing is also proposed for a similar reason to that in the transfer and fixing independent technique (JP-A-8-76620, JP-A-2000-188177, JP-A-2000-268952, etc.,).

As described above, in the electrophotographic apparatus, adoption of the electromagnetic induction heating technique is examined, but the electromagnetic induction heating technique involves the magnetic field generation section as the main component for heating. Therefore, in the magnetic field generation section in the electrophotographic apparatus, of course, it is also desirable that the eddy-current loss should be suppressed, thereby accomplishing still more energy saving at low cost. In recent years, miniaturization of the electrophotographic apparatus has been underway, and in the electrophotographic apparatus adopting the electromagnetic induction heating technique for fixing or transferring and fixing, it is desirable that the flexibility of the shape of the magnetic core is enhanced to expand the flexibility in designing the apparatus and further the apparatus should be still more miniaturized.

Further, since the electrophotographic apparatus is installed in an office, etc., it is desirable that leakage of a magnetic field from the magnetic field generation section should be prevented so as not to affect various machines installed in the proximity of the electrophotographic apparatus and to protect the human bodies against the effect of a magnetic field. Thus, it is desirable that a member capable of shielding the magnetic field from the magnetic field generation section still more effectively should be adopted as a magnetic field shield member installed in the periphery of the magnetic field generation section.

It is therefore an object of the invention to provide a magnetic core making it possible to set inductance at low cost and easily as the magnetic core is installed in a coil or a transformer and a magnetic field shield member capable of suppress an electromagnetic field leakage efficiently.

It is another object of the invention to provide an electrophotographic apparatus adopting an electromagnetic induction heating technique for fixing or transferring and fixing wherein a magnetic core suppressing an eddy current loss and having high flexibility in shape is used for magnetic field generation section, so that still more energy saving can be accomplished at low cost, the flexibility in designing the apparatus can be expanded, and further the electromagnetic apparatus can be still more miniaturized.

It is still another object of the invention to provide an electrophotographic apparatus adopting an electromagnetic induction heating technique for fixing or transferring and fixing wherein magnetic field leakage from magnetic field generation section can be shielded effectively.

SUMMARY OF THE INVENTION

In order to accomplish the objects, in the invention, an aggregate of magnetic particles is used for a magnetic core forming an inductance element such as a coil or a transformer and a part of a magnetic material acting on an inductance element to improve the electromagnetic characteristic of the coil or the transformer and to suppress electromagnetic field leakage.

In particular, a magnetic core of the invention has a magnetic field generation member for supplying magnetic field, a vessel and magnetic particles, in which the magnetic particles form an aggregate and in which the aggregate of the magnetic particles is disposed in the vessel while the magnetic particles are keeping a particle state.

An aggregate of magnetic particles is used as the magnetic material forming the magnetic core and the vessel is filled with the magnetic particles with the particle state of the magnetic particles maintained, so that the shape of the magnetic core can be set as desired and the magnetic core of any desired shape can be easily manufactured simply by selecting the shape of the vessel appropriately.

The magnetic core of the invention adopts the magnetic particles as the magnetic core material and the magnetic particles are maintained intact in the particle state, so that occurrence of the eddy current in the magnetic core can be canceled. Thus, the heat loss of an eddy current can be canceled.

In order to maintain the particle state of the magnetic particles, preferably the shape as the whole of the aggregate of magnetic particles to be used is maintained. Thus, a vessel is used and is filled with magnetic particles, so that the shape as the whole of the aggregate of magnetic particles to be used can be maintained with the particle state maintained.

A magnetic field generation member in which the magnetic core of the invention is disposed may adopt an inductance element such as a coil or a transformer. Most elements for generating a magnetic field are inductance elements such as coils or transformers and the magnetic core is set to any desired shape, thereby making it possible to design the shape of the inductance element as desired.

The magnetic particle includes at least one of iron powder, ferrite powder, and magnetite powder.

The type of magnetic particles is not limited if the magnetic particles can maintain the particle state. If powder of at least iron powder, ferrite powder, or magnetite powder, namely, magnetic particles are adopted in one type or in combination, the characteristic of the magnetic particles can be set as desired.

the vessel has a shape responsive to the temperature characteristic produced by electromagnetism acting on the magnetic particles.

Heat generated by electromagnetism passing through a magnetic material may be used in some cases. For example, it may be used as a heat energy source of a fuser, etc., in an image formation unit. In this case, if characteristic of generated heat, namely, temperature characteristic is contained, preferably the magnetic core of the characteristic matching the temperature characteristic is formed. Then, the shape of magnetic particles is made a shape responsive to the generated temperature characteristic, so that it is made possible to form the magnetic core considering the generated temperature.

The vessel can be made of a nonmagnetic material. The vessel made of a nonmagnetic material is adopted, so that it does not affect the electromagnetic characteristic and the characteristics of the aggregate of magnetic particles with which the vessel is filled and an adjustment element contained in the vessel as required can be optimized to provide any desired magnetic core.

Preferably, the vessel has a lid to allow the magnetic particles to be inserted into and removed from the vessel and the lid seals the vessel.

The vessel is provided with a lid to allow the magnetic particles to be inserted into and removed from the vessel and sealed, so that if the magnetic particles or the vessel is degraded as the magnetic particles or the vessel is used, the magnetic particles and the vessel can be replaced separately and excellent recyclability can be provided.

An adjustment element for adjusting a filling amount of the magnetic particle may be contained in the vessel The magnetic particles are in the particle state and thus can be easily changed in shape. An excessive space may occur depending on the amount of the magnetic particles stored in the vessel. If an adjustment element of a capacity matching the excessive space is contained in the vessel, a vessel having a given capacity can be used and the amount of the magnetic particles stored in the vessel can be adjusted. The shape of the adjustment element is changed, whereby it is made possible to control the magnetic particle distribution in the vessel whenever necessary.

At this time, the adjustment element may be a magnetic substance in a solid state. the adjustment element may also be in a solid state and be made of a nonmagnetic material.

The magnetic core may also be formed of magnetic particles only. However, when a magnetic substance in a solid state having a predetermined characteristic exists, the magnetic particles in the invention may also be used to make adjustment to the magnetic substance.

A magnetic field shield member of the invention is placed in the periphery of magnetic field generation member for generating a magnetic field to shield the magnetic field generated by the magnetic field generation member, the magnetic field shield member made of an aggregate of magnetic particles and filled with the magnetic particles in a vessel with the particle state of the magnetic particles maintained.

The inductance element such as a coil or a transformer may leak a magnetic field to the outside. The magnetic field leaked to the outside changes depending on the shape or the installation point of the inductance element. Thus, the magnetic field shield member is formed of an aggregate of magnetic particles, so that the magnetic field generated by the magnetic field generation member can be shielded efficiently.

Preferably, the magnetic field generation member is a coil or a transformer.

Preferably, the magnetic particles in the magnetic field shield member of the invention includes at least one of iron powder, ferrite powder, and magnetite powder.

Preferably, the vessel has a lid to allow the magnetic particles to be inserted into and removed from the vessel and the lid seals the vessel.

The vessel is provided with a lid to allow the magnetic particles to be inserted into and removed from the vessel and sealed, so that if the magnetic particles or the vessel is degraded as the magnetic particles or the vessel is used, the magnetic particles and the vessel can be replaced separately and excellent recyclability can be provided.

On the other hand, the magnetic core and/or the magnetic field shield member of the invention can be preferably used with an electrophotographic apparatus adopting an electromagnetic induction heating technique for fixing or transferring and fixing. The specific configurations of the electrophotographic apparatus are as follows ((1) and (2)): (1) An electrophotographic apparatus has an image formation unit for forming an unfixed toner image on a surface of a record medium by using electrophotography, a fuser unit having a fixing rotation body and a pressurizing rotation body disposed to press against the fixing rotation body to define a nip part therebetween, and a magnetic field generation member for generating magnetic field, in which the record medium is inserted into the nip part so that a surface of the record medium on which the unfixed toner image is formed contacts with the fixing rotation body, whereby the fuser unit fixes the unfixed toner image on the surface of the record medium, in which a conductive layer is formed in the proximity of the circumferential surface of one of the fixing rotation body and the pressurizing rotation body, and in which the magnetic field generation member is placed close to the one of the fixing rotation body and the pressurizing rotation body.

In this case, the magnetic core of the invention can be preferably used in the magnetic field generation member. To shield at least a part of a leakage magnetic field not affecting the conductive layer, of the magnetic field generated from the magnetic field generation member, preferably the magnetic field shield member of the invention is placed in the periphery of the magnetic field generation member. Of course, preferably the magnetic core of the invention is used in the magnetic field generation member and further the magnetic field shield member of the invention is placed in the periphery of the magnetic field generation member.

As the fixing rotation body and the pressurizing rotation body, a roll-like body and an endless belt body may be selected in any desired combination.

(2) An electrophotographic apparatus has an image support rotation body, an image formation unit for forming an unfixed toner image on a circumferential surface of the image support rotation body by using electrophotography, a heating member disposed in the image support rotation body to abut against the image support rotation body (if necessary), a pressurizing member disposed to face the heating member through the image support rotation body to define a nip part between the pressurizing member and the image support rotation body, and a magnetic field generation member for generating a magnetic field, in which a record medium is inserted into the nip part, whereby the unfixed toner image is transferred and fixed onto a surface of the record medium by heat and pressure, in which a conductive layer is formed at one of a place which is in the proximity of the circumferential surface of the image support rotation body and another place which is in the proximity of an abutment part of the heating member against the image support rotation body, in which when the conductive layer is formed in the image support rotation body is formed, the magnetic field generation member is disposed close to one of the nip part of the image support rotation body and a place on the image support member in the upstream in relation to the nip part, and in which when the conductive layer is formed in the heating member, the magnetic field generation member is disposed close to the heating member.

Also in this case, the magnetic core of the invention can be preferably used in the magnetic field generation member. To shield at least a part of a leakage magnetic field not affecting the conductive layer, of the magnetic field generated from the magnetic field generation member, preferably the magnetic field shield member of the invention is placed in the periphery of the magnetic field generation member. Of course, preferably the magnetic core of the invention is used in the magnetic field generation member and further the magnetic field shield member of the invention is placed in the periphery of the magnetic field generation member.

The image support rotation body may be shaped like a roll or an endless belt.

BRIEF DESCRIPTION OF THE DRAWINGS

FIG. 2A shows an example of storing magnetic particles in a vessel, FIG. 2B shows an example of adjusting the magnetic particle storage amount according to the diameter of a vessel, FIG. 2C shows an example of changing the magnetic particle amount, and FIG. 2D shows an example of using an adjustment element to adjust magnetic particles.

FIG. 3A shows inductance ($\mu$H) fluctuation and FIG. 3B shows impedance Z ($\Omega$) fluctuation.

FIG. 4A shows coil resistance component R ($\Omega$) and FIG. 4B shows phase angel $\theta$ of circuit (cos $\theta$ is power factor).

FIG. 8A shows relationship between the position and the heat outflow quantity, FIG. 8B shows a structure example, FIG. 8C shows another structure example, and FIG. 8D shows another structure example.

DETAILED DESCRIPTION OF THE PREFERRED EMBODIMENTS

Referring now to the accompanying drawings, there are shown preferred embodiments of the invention in detail.

[First Embodiment]

To begin with, a first embodiment concerning a magnetic core of the invention that can be used as an inductance element and has adjustable magnetic permeability easily and at low cost will be discussed.

Figure 1:
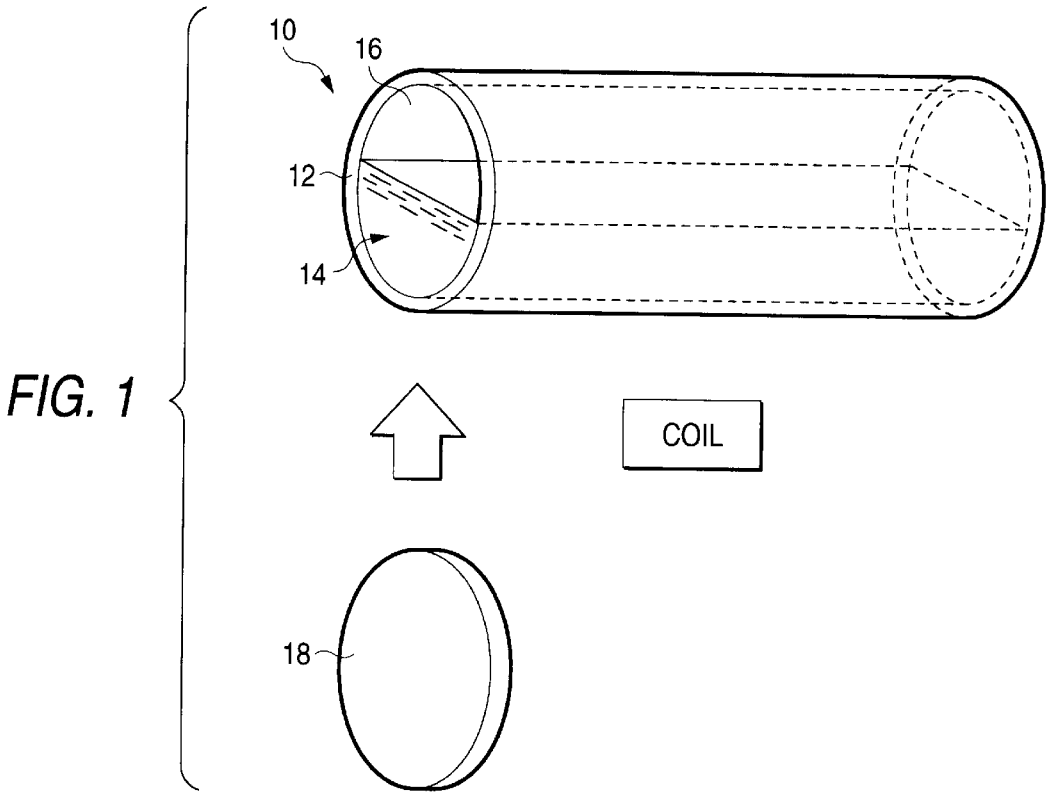
FIG. 1 is a perspective view to show a magnetic core according to a first embodiment of the invention.

As shown in FIG. 1, a magnetic core 10 of the invention includes a cylindrical vessel 12 and an aggregate of magnetic particles 14. The vessel 12 is filled with the aggregate of magnetic particles 14 with the particle state maintained. The vessel 12 has a nonmagnetic material such as plastic and a conductive material such as a coil is wound around the vessel 12, whereby the vessel 12 can serve as an inductance element. The magnetic core 10 made up of the vessel 12 and the aggregate of the magnetic particles 14 is sealed with a lid 18 to allow the magnetic particles 14 to be inserted into and removed from the vessel 12 and sealed so that the magnetic particles 14 do not flow out to the outside of the vessel 12. The vessel 12 is provided with the lid 18 to allow the magnetic particles 14 to be inserted into and removed from the vessel 12 and sealed, so that if the magnetic particles 14 or the vessel 12 is degraded as the magnetic particles 14 and the vessel 12 are used, the magnetic particles 14 and the vessel 12 can be replaced separately. Further, in case of discarding the apparatus using them, the magnetic particles 14 and the vessel 12 can also be taken out separately; excellent recyclability can be provided. The sealing member of the lid 18 is not limited particularly; every technique from simple fitting, screwing to special joint member can be adopted. The lid 18 may be placed at any point other than the end part of the vessel 12 and the placement point of the lid 18 may be selected appropriately in response to the shape of the vessel 12.

At least one side of the vessel 12 can be sealed with the lid 18. In case of putting the lid on only one side of the vessel 12, the vessel 12 is formed so as not to pierce the other side.

In case of storing the magnetic particles 14 in the vessel 12, the volume of the magnetic particles 14 may be less than the capacity of the vessel 12. In this case, to ensure the uniformity of the magnetic particles 14 in the vessel 12, a nonmagnetic material can be stored in a space 16 produced in the vessel 12 as an adjustment element. The nonmagnetic material stored in the space 16 is intended to prevent the magnetic particles 14 from flowing in the vessel 12 and a microstructure is not required.

Only the amount of the magnetic particles 14 fitted for the magnetic permeability required as the magnetic core of an inductance element is thus stored in the vessel 12, so that the magnetic core capable of forming the inductance element having the magnetic permeability required can be manufactured. That is, in the embodiment, the magnetic particles are used as the magnetic core to provide the required magnetic permeability and thus the magnetic core can be easily molded to any of various shapes and can be easily manufactured.

In case of adding the magnetic core to a product as an inductance element, only a vessel may be provided and be installed for assembling and finally may be filled with the magnetic particles. In doing so, the inductance element can be formed at the product manufacturing time and adjustment of design values or the like can be easily performed.

Further, to use a metal material such as a silicon steel plate or a ferrite sintered substance as the magnetic core material, an eddy current occurs and a heat loss (so-called eddy-current loss) occurs because of large conductivity. Thus, an avoidance measure of forming the metal material thin and molding to a multilayered structure of the metal material is required. However, the magnetic particles are adopted as the magnetic core material and the magnetic material is maintained intact in the particle state, so that occurrence of the eddy current in the magnetic core can be canceled. Thus, the heat loss due to the eddy current can be canceled. Thus, utilizing the magnetic core material using the magnetic particles, the loss in a high-frequency band can be decreased.

The magnetic particles of a characteristic element in the invention will be discussed.

The magnetic particles includes particulate matter having a reasonable particle diameter in addition to fine powder. That is, the particle diameter can be selected in a wide range from an extremely fine particle diameter to a large particle diameter of iron waste material, etc. Specifically, any can be selected from among particles having particle diameters in a wide range of 0.1 $\mu$m to 1 mm. However, preferably the lower limit of the particle diameters is 1 $\mu$m or more and more preferably 5 $\mu$m or more from the viewpoint of availability, fluidity, handleability, etc. Likewise, preferably the upper limit of the particle diameters is 500 $\mu$m or less and more preferably 200 $\mu$m or less.

The shape of a particle is not limited and any shape can be selected. For example, a spherical shape, a needle shape, a clot shape, a flat shape, a porous shape, an indeterminate shape, or the like or a mixture of the shapes can be named. Among them, the spherical shape is preferred from the viewpoint of availability and fluidity.

As the magnetic particles, specifically iron powder, ferrite powder, and magnetite powder can be named as preferred particles, and one of them may be used singly or a plurality of them may be mixed for use.

For example, as the magnetic particles, industrial magnetic particles can be used. Specifically, for example, iron powder carrier and ferrite carrier for electrophotography made commercially available by Powdertech Co., Ltd. are preferred. The iron powder carrier using reduced iron powder, atomize iron powder, cutting waste, etc., or iron powder provided by crushing cuttings and adjusting the particle degree, or oxide film iron powder coated with an extremely thin oxide film of iron can be named. Resin-coated iron powder coated with resin to adjust the electric resistance is also known. As the ferrite carrier, soft ferrite typified by $MO_a.M'O_b(Fe_2O_3)_x$ (where M and M' indicate metal elements and a, b, and x indicate integers), for example, powdered ferrite of Ni—Zn ferrite, Mn—Zn ferrite, Cu—Zn ferrite, etc., can be named.

As other magnetic particles, iron powder for powder metallurgy, iron powder for shot, iron powder for deoxidant, iron powder for body warmer, iron powder for chemical reduction, iron powder for welding electrode, iron powder for powder cutting, iron powder filled in deoxidant, any other rubber, or plastic, and the like can be named.

In the invention, the vessel is filled with the magnetic particles in an aggregate state and with the particle state maintained. The bulk density as the aggregate of the magnetic particles is roughly in a range of 1.0 to about 6.0 g/cm$^3$ and preferably roughly in a range of 1.5 to 5.0 g/cm$^3$.

The expression "particle state maintained" is used to mean a state in which the magnetic particles are physically independent of each other as particles, and does not include a state in which the magnetic particles are melted upon heating, etc., and each particle state is lost. However, when the particles are compressed to fill the vessel or when the particles are joined to form a clot by compression or with time, the physical state of each particle is maintained although fluidity as a particle is simply lost, and such a state is contained in the concept of "particle state maintained."

As the magnetic particles in the invention is used for the material of the magnetic material, it is desirable that magnetic particles having the following magnetic property and electric property are selected:

<Magnetic Property>

Saturation magnetization is in a range of 10 to 500 emu/g;

remaining magnetization is 15 emu/g or less;

coercive force is 500 e or less; and relative permeability is 2 to 100.

<Electric Property>

Electric resistance is $10^8$ Ωcm or more (when voltage of 250 volts is applied)

Using the magnetic particles having these specifications to form a magnetic core, for example, the magnetic core is installed in a part of a coil or a transformer as an inductance element and the magnetic and electric characteristics can be adjusted in the target range.

In the embodiment, the vessel 12 is cylindrical, but the invention is not limited to the cylindrical shape and any of various shapes can be selected in response to the purpose. For example, an elliptic cylindrical shape, a rectangular parallelepiped shape, a polygonal pole shape such as a triangle pole shape or a hexagonal pole shape, a conical shape, a truncated conical shape, a pyramid shape, a truncated pyramid shape, or any other arbitrary shape can be selected appropriately in response to the operating condition, the installation place, the required magnetic characteristic, etc. A shape responsive to the temperature characteristic produced by electromagnetism acting on the magnetic particles can also be adopted as described later.

Here, with reference to FIG. 2, in case of using the magnetic particles 14 for the magnetic core, a mode of adjusting the storage amount of the magnetic particles 14 depending on the shape of the vessel 12, etc. will be discussed.

Figure 2A:
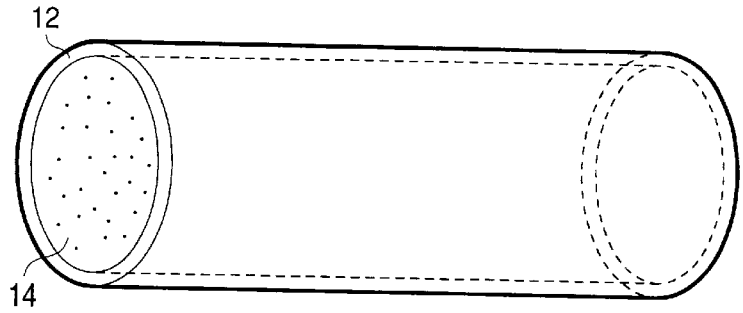
FIGS. 2A to 2D are schematic representations to describe a mode of magnetic particle adjustment.
Figure 2B:
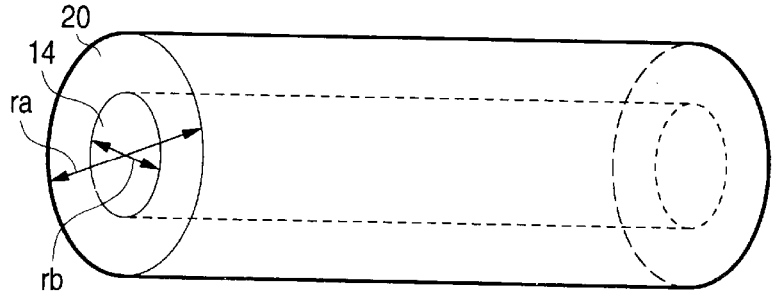

FIG. 2A shows an example of storing the magnetic particles 14 in the cylindrical vessel 12 shown in FIG. 1. FIG. 2B shows an example wherein it is made possible to adjust the storage amount of the magnetic particles 14 by adjusting the diameter of the cylindrical vessel 22 shown in FIG. 1. In the example in FIG. 2B, for a vessel 20, outer diameter ra of the vessel 20 is set based on the space of installation using the magnetic core 10 and the like. Inner diameter rb which is smaller than the outer diameter ra is changed, whereby the amount of the magnetic particles 14 stored in the magnetic core 10 can be adjusted.

Figure 2C:
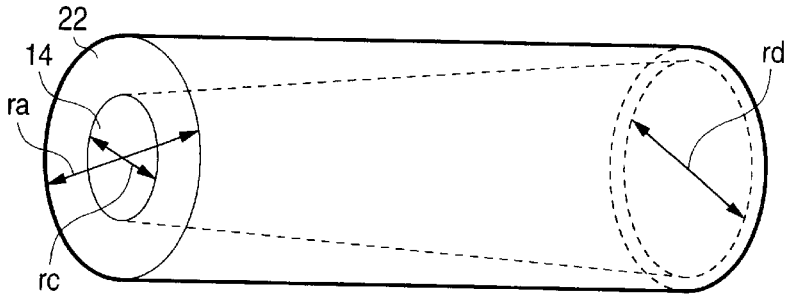

FIG. 2C shows an example wherein the amount of the magnetic particles 14 stored in the magnetic core 10 is inclined in the axial direction of the magnetic core 10. In the example, unlike the vessel 12 having the same inner diameter, a vessel 22 having different inner diameters rc and rd (rc<rd) is used. In doing so, the amount of the magnetic particles 14 is increased gradually from left to right of the drawing along the axial direction of the magnetic core 10. The inclination of the inner diameter of the vessel 22 may be linear or may be nonlinear. For example, the inner diameter can be maintained in a portion where a given amount of the magnetic particles 14 is required structurally and can be formed stepwise or the vessel 22 can have almost the same inner diameter on both sides and the inner diameter changed inside of the vessel 22.

Figure 2D:
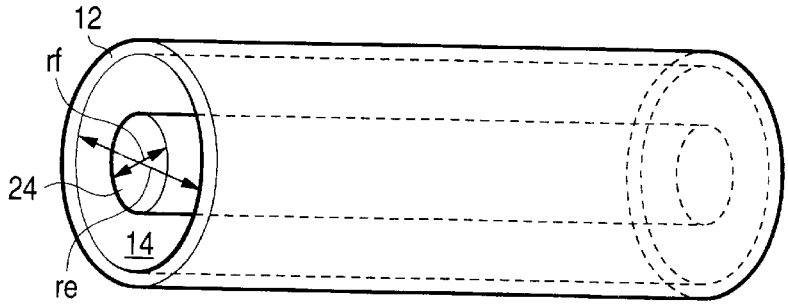

FIG. 2D shows an example wherein an adjustment element 24 made of a magnetic substance in a solid state or a nonmagnetic material in a solid state is installed in the vessel 12 and it is made possible to adjust the storage amount of the magnetic particles 14 according to the size of the adjustment element 24. In the example in FIG. 2D, the adjustment element 24 which is cylindrical and has an inner diameter rf smaller than the outer diameter re of the vessel 12 is used. In the example, the vessel 12 of the same shape is used and the diameter rf of the adjustment element 24 is changed, whereby a different amount of the magnetic particles 14 can be stored while the magnetic core 10 has the same outer diameter.

The expression "solid state" is used to mean a state in which a constant shape is held and a cluster state occupying a constant volume, and does not include a state of a substance having fluidity like liquid or particles and having no shape holding property as a whole.

A nonmagnetic material is used as the material of the adjustment element 24, whereby the physical advantage of making it possible to adjust the storage amount of the magnetic particles 14 can be produced. A magnetic material in a solid state such as a ferrite core or a soft ferrite of a constant shape is used, whereby it is made possible to adjust the effect of the electromagnetic nature of the magnetic material in a solid state by adjusting the filling amount with the magnetic particles in the invention.

In the invention, the amount distribution of the magnetic particles 14 is appropriately adjusted according to the shape of the vessel, for example, by changing the thickness of the vessel as previously described, whereby the shape responsive to the temperature characteristic produced by electromagnetism acting on the magnetic particles can also be provided. It is also made possible to form the magnetic core considering the generated temperature by changing the shape of the vessel itself in response to the temperature characteristic produced by electromagnetism acting on the magnetic particles.

Next, the effect of the electromagnetic nature depending on the filling amount with the magnetic particles will be discussed. In the description that follows, the case where the magnetic core 10 shown in FIG. 1 was used and spherical particles having a volume average particle diameter of 75 $\mu$m (in a range of 40 to 105 $\mu$m as a distribution) were used as the magnetic particles 14 is taken as an example. A cylindrical vessel made of a material of polyphenylene sulfide and having an inner diameter of 14 mm, an outer diameter of 17 mm, and a whole length of 350 mm was used as the vessel 12.

FIGS. 3 and 4 show experimental results indicating change in the characteristic values of the electromagnetic property when the filling amount with the magnetic particles 14 was changed. Here, with the magnetic core 10 shown in FIG. 1 as a coil core, a coil is wound around the coil core (material of lead wire: Copper, thickness: 2.5 mm, the number of turns: 125) to form an inductance element. Characteristic values were obtained when a signal was applied to the coil at predetermined frequencies (in the embodiment, three types of frequencies of 25 kHz, 30 kHz, and 35 kHz). Measurements on three types of 48.4 g, 77.8 g, and 166.3 g as the whole mass of the aggregate of the magnetic particles 14 were conducted. When the vessel 12 was filled with the magnetic particles 14 and the space 16 occurred, the characteristics were measured under a state where the magnetic particles 14 were placed uniformly in the axial direction of the vessel 12.

Figure 3A:
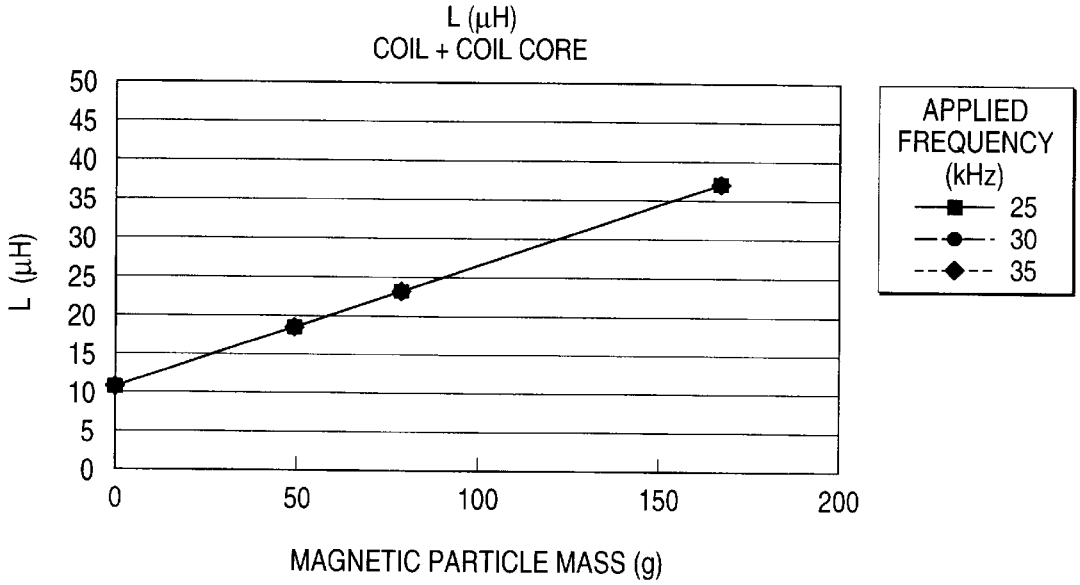
FIGS. 3A and 3B show change in the characteristic values of electromagnetic property when the storage amount of magnetic particles is changed.
Figure 3B:
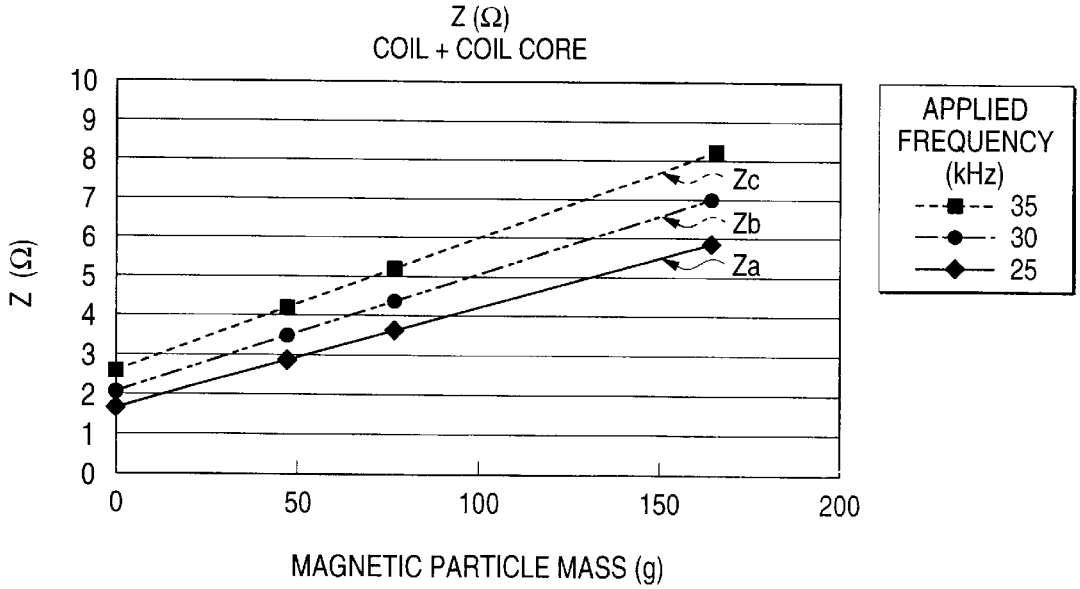
Figure 4A:
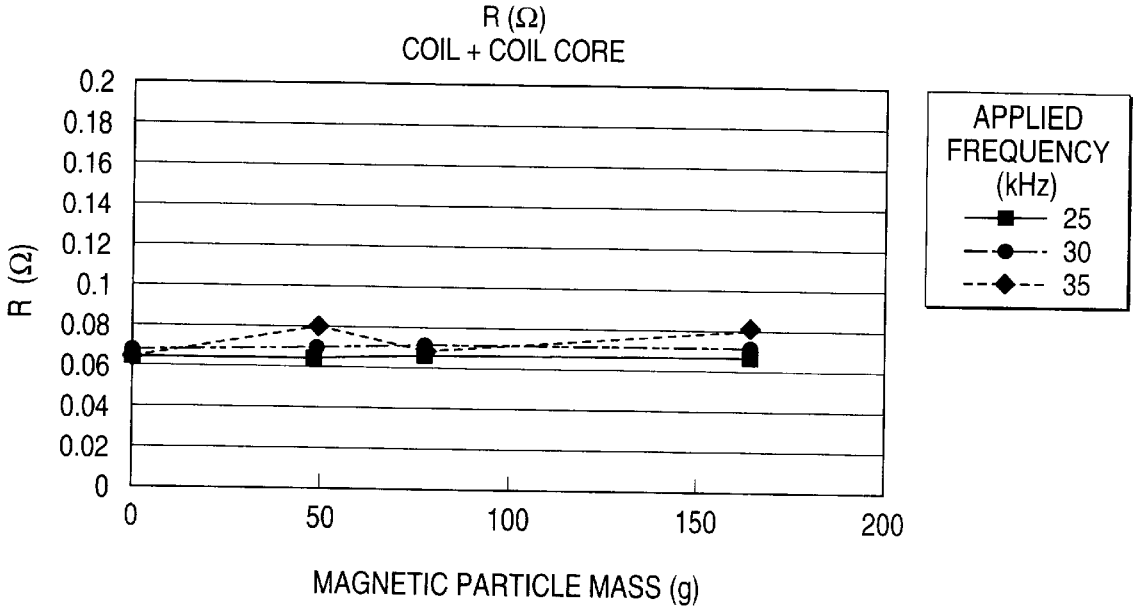
FIGS. 4A and 4B show change in the characteristic values of electromagnetic property when the storage amount of magnetic particles is changed.
Figure 4B:
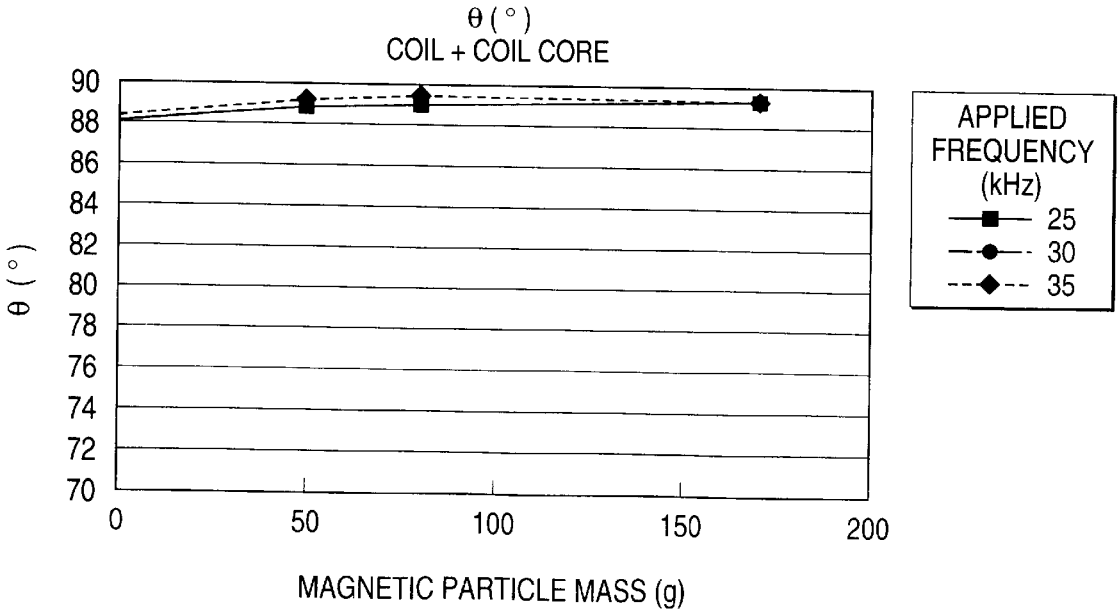

FIG. 3A shows inductance ($\mu$H) fluctuation relative to the filling amount with the magnetic particles 14 and FIG. 3B shows impedance Z (Ω) relative to the filling amount with the magnetic particles 14. FIG. 4A shows a coil resistance component R (Ω) and FIG. 4B shows a phase angel θ of circuit (cos θ is power factor).

As shown in FIG. 3A, the inductance ($\mu$H) fluctuation of the inductance element is scarcely affected by the frequency in the range of the applied signal frequencies (in FIG. 3A, lines and plots for each applied frequency overlap) and the inductance also tends to increase with an increase in the storage amount of the magnetic particles 14. The relationship between the applied signal frequency and the inductance will be discussed later in detail.

As shown in FIG. 3B, the impedance Z (Ω) relative to the filling amount with the magnetic particles 14 tends to increase with an increase in the storage amount of the magnetic particles 14. The impedance characteristic depends on the applied signal frequency. That is, the impedance Z (Ω) tends to increase with an increase in the applied signal frequency; when the 25-kHz frequency is applied, characteristic Za is provided; the 30-kHz frequency is applied, characteristic Zb is provided; and the 35-kHz frequency is applied, characteristic Zc is provided.

As shown in FIG. 4A, the coil resistance component R (Ω) relative to the filling amount with the magnetic particles 14 tends to be an almost flat characteristic or tends to slightly increase in the range of the applied signal frequencies. Thus, it is understood that the coil resistance component has low dependency on the filling amount with the magnetic particles 14.

As shown in FIG. 4B, the phase angel θ of circuit (cos θ is power factor) relative to the filling amount with the magnetic particles 14 is scarcely affected by the frequency in the range of the applied signal frequencies and the phase angel θ tends to slightly increase with an increase in the filling amount with the magnetic particles 14.

Figure 5:
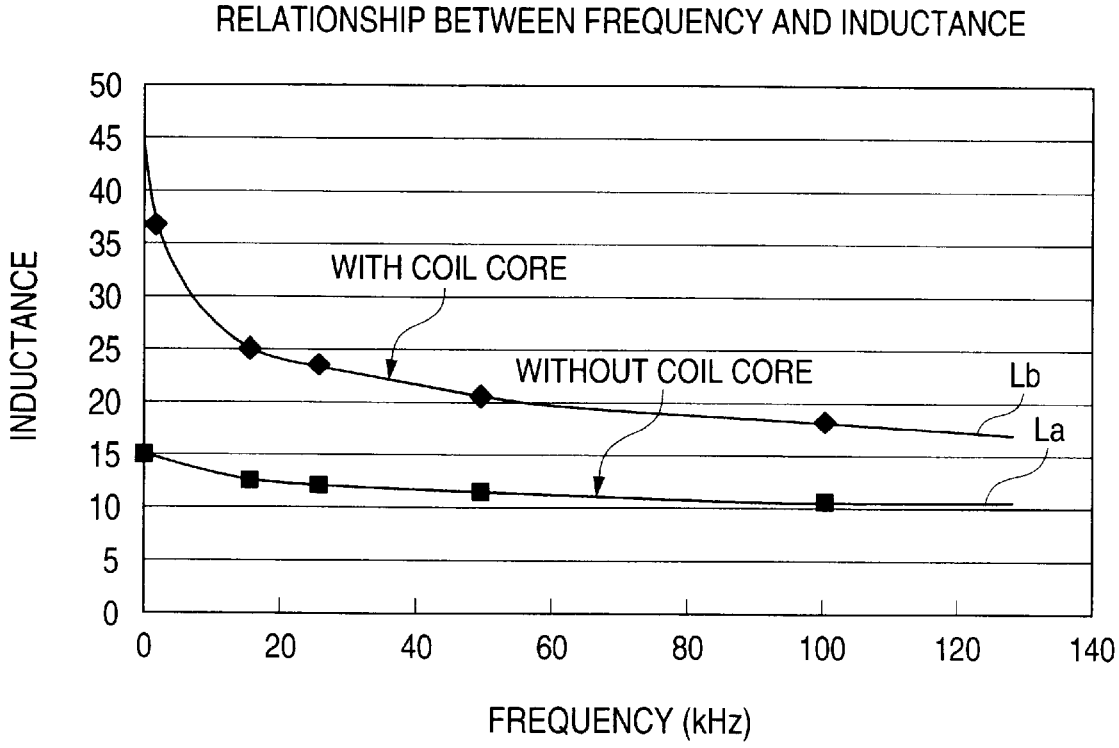
FIG. 5 is a characteristic drawing to show relationship between applied signal frequencies and inductance for both a case where a coil core (magnetic core) is contained and a case where no coil core is contained.

Next, in order to make obvious the change in the characteristic values of the electromagnetic property depending on the filling amount with the magnetic particles 14, the relationship between the applied signal frequency and the inductance was found for both a case where a coil core (magnetic core) is contained as the inductance element and a case where no coil core is contained. FIG. 5 shows the experimental result. Inductance when signals at predetermined frequencies (in the embodiment, five types of frequencies of 1 kHz, 15 kHz, 25 kHz, 50 kHz, and 100 kHz) were applied to the coil was found and the characteristics interpolated by a least squares method, etc., are shown in FIG. 5. Characteristic Lb when the coil core (magnetic core) is contained and characteristic La when no coil core (magnetic core) is contained are also shown in FIG. 5.

As seen in FIG. 5, in both the characteristics La and Lb, the inductance tends to decrease with an increase in the applied signal frequency. In the characteristic La when no coil core is contained, the inductance tends to slightly decrease; in the characteristic Lb when the coil core is contained, the inductance fluctuation tendency appears noticeably as compared with that in the characteristic La.

Machines to which a coil or a transformer, which is an example of the inductance element having the magnetic core described above, can be applied include a machine using an electromagnetic coil, a machine using a high-frequency circuit or an inverter circuit, and an electric machine such as a motor machine.

For example, the machines each using an electromagnetic coil include a television, a videocassette recorder, an electric shaver, an electric toothbrush, a washing toilet seat, a refrigerator, a facsimile machine, a hand mixer, a ventilating fan, an electric sewing machine, an electric pencil cutter, a CD player, a washing machine, a dryer, a fan, a juice mixer, an air conditioner, an air cleaner, an electrophotographic copier, a vending machine, an electromagnetic valve, etc.

For example, the machines each using a high-frequency circuit or an inverter circuit include an electromagnetic cooker, a microwave oven, PHS, a radio pager, a mobile telephone, a cordless telephone, a desktop personal computer, a notebook personal computer, a word processor, a video game machine, a humidifier, a fluorescent lamp, audio machines such as an amplifier and a tuner, etc.

The motors include a servomotor, a pulse motor, and a stepping motor. For example, the machines each having any of the motors include quartz oscillation type timepiece such as a wrist watch, a table clock, a wall clock, and a stopwatch, a pacemaker, a camera, a videocassette recorder, a video camera, machines for handling rotation-type storage media such as MD, CD, CD-R, CD-RW, FD, PD, and MD, a metering pump, etc.

Further, for example, other electric machines to which the coil or the transformer, which is an example of the inductance element having the magnetic core described above, can be applied include an electric machine AC adapter, a laser-beam printer, a thermal transfer printer, a dot-impact printer, a CRT display, a liquid crystal display, a plasma display, a GPS navigation device, a magnetic detection sensor, a hearing aid, a charger, etc.

In the embodiment, the aggregate of magnetic particles can be changed in volume and shape as desired because the magnetic particles are particulate, and the aggregate can be easily formed to the required size and shape. Therefore, the magnetic particles are used as a part of a magnetic core forming a part of a coil or a transformer, whereby the flexibility of circuit design using an inductance element is increased.

Thus, in the embodiment, the magnetic particles are applied to the inductance element, whereby the inductance element can be easily molded to any of various shapes. The aggregate of magnetic particles is only installed in a part of the magnetic core of a coil or a transformer, so that the inductance of the coil or the transformer can be flexibly designed over a wide range. Further, the magnetic particle itself has adequate electric resistance and thus the self-heating problem caused by so-called induction heating is extremely small even in a high frequency band and therefore the loss is small and the effective magnetic permeability can be enhanced even in the high frequency band.

[Second Embodiment]

Next, a second embodiment concerning a magnetic field shield member of the invention capable of providing a function of suppressing an electromagnetic field leakage easily and at low cost will be discussed.

In the first embodiment, the example has been described wherein an aggregate of magnetic particles is installed in a part of the magnetic core forming a part of an inductance element such as a coil or a transformer to improve the electromagnetic characteristic of the coil or the transformer. However, an aggregate of magnetic particles can also be used to provide a function of suppressing an electromagnetic field leakage. For example, an aggregate of magnetic particles can be used as a magnetic field shield member for shielding an electromagnetic field leakage in the surroundings of magnetic field generation member such as not only a coil or a transformer having a magnetic core, but also an air-core coil or transformer having a winding only and a permanent magnet.

The magnetic field generation member such as an inductance element may involve an electromagnetic field leakage. However, a portion where an inductance element is installed may have a small excessive space or small shape flexibility. Then, using an aggregate of magnetic particles as the magnetic field shield member for shielding an electromagnetic field leakage, a highly flexible magnetic field shield member whose volume and shape can be adjusted whenever necessary can be provided.

For example, when a coil or a transformer has a magnetic core and a winding is assembled, in order to shield an electromagnetic field leakage, a space (vessel) capable of holding magnetic particles is provided in the portion to shield an electromagnetic field leakage in advance and is filled with a necessary amount of magnetic particles, whereby a magnetic field shield member can be formed to shield an electromagnetic field leakage.

Figure 6:
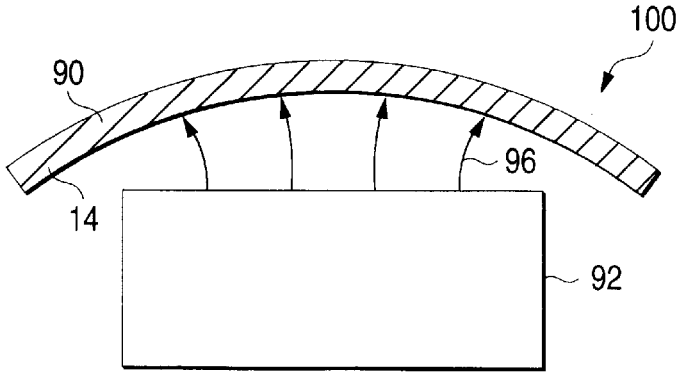
FIG. 6 is a schematic drawing to show a magnetic field shield member according to a second embodiment of the invention.

FIG. 6 is a schematic sectional view to show a state in which the magnetic field shield member according to the embodiment is placed in the periphery of magnetic field generation member. In FIG. 6, numeral 100 denotes the magnetic field shield member having a function for shielding a leakage magnetic field 96 produced from magnetic field generation member 92. As the magnetic field generation member 92, a permanent magnet, etc., can be named in addition to inductance elements of a coil, a transformer, etc. Further, various electric and electronic machines containing them are all included. Although the magnetic field generation member 92 needs to form a magnetic field, of course, to carry out its function, a magnetic field also easily leaks to a part not affecting carrying out the function of the magnetic field generation member 92 because of the machine design. The magnetic field shield member 100 of the embodiment provides the function for shielding such leakage magnetic field 96.

The magnetic field shield member 100 has a thin-plate vessel 90 shaped like a curved surface and capable of storing magnetic particles therein and an aggregate of magnetic particles 14 filling the vessel 90. The face of the magnetic field shield member 100 opposed to the magnetic field generation member 92 is shaped like a curved surface to surround the magnetic field generation member 92 so as to make it possible to effectively shield the leakage magnetic field 96 produced from the magnetic field generation member 92. Of course, in the invention, the shape of the magnetic field shield member 100, namely, the shape of the vessel 90 is not limited to the shape like a curved surface; any shape of a flat plate, a box, a ship, angular U, a mountain, a dome, a roof, or a combination thereof can be selected appropriately considering a way of a leakage magnetic field leaking, excessive space of machine, the shape of magnetic field generation member, etc.

As with the first embodiment, preferably the vessel 90 is provided with a lid (not shown) to allow the magnetic particles 14 to be inserted into and removed from the vessel 90 and sealed. Such a lid is provided, whereby if the magnetic particles 14 or the vessel 90 is degraded as the magnetic particles 14 and the vessel 90 is used, the magnetic particles 14 and the vessel 90 can be replaced separately. Further, to discard the apparatus using them, the magnetic particles 14 and the vessel 90 can also be taken out separately; excellent recyclability can be provided. The sealing member of the lid is not limited; every technique from simple fitting, screwing to special joint member can be adopted. The placement point of the lid may be selected appropriately in response to the shape of the vessel.

The types and the properties (shape, bulk density, magnetic property, and electric property) of magnetic particles that can be used in the embodiment are similar to those previously described in the first embodiment. The thickness of an aggregate of magnetic particles filled and molded may be adjusted appropriately depending on the strength of a leakage magnetic field.

According to the embodiment, the electromagnetic field leakage can be suppressed or shielded effectively and the performance of an apparatus (machine) can be enhanced easily and at low cost without impairing miniaturization as the whole apparatus (machine). Further, the method of suppressing a magnetic flux leakage using the magnetic field shield member of the embodiment is applied to various electric machines, whereby the leakage magnetic flux density can be decreased easily and at low cost.

[Third Embodiment]

Next, a third embodiment of applying an inductance element using a magnetic core of the invention to an electrophotographic apparatus as an electric machine will be discussed. In the third embodiment, particularly, applying the magnetic core of the invention to a fuser in an electrophotographic apparatus will be discussed. The embodiment has an almost similar configuration to that of the above-described embodiment and therefore parts identical with those previously described are denoted by the same reference numerals and will not be discussed again in detail.

Generally, an electrophotographic apparatus comprises image formation unit for forming an unfixed toner image on the surface of a record medium using electrophotography and fuser unit for fixing toner image on the surface of the record medium on which the unfixed toner image is formed.

Hitherto, a fuser as fuser unit for heating and fixing a material to be fixed typified by toner on a record material has been used with a recorder of heating and fixing type in a copier, a printer, etc. As the heating method of the fuser, a lamp method of heating with a lamp such as a halogen lamp and an electromagnetic induction heating method of heating by interlinking an alternating magnetic field with a magnetic conductor and generating an eddy current are available.

The fuser adopting the electromagnetic induction heating method can directly heat a heated material such as a thermal roll by using Joule heat produced by an eddy current and thus has the advantage that highly efficient heating can be carried out as compared with the lamp method.

In the embodiment, an example of using the fuser adopting the electromagnetic induction heating method as fuser unit is shown. In the embodiment, as the fuser, a fuser of so-called roll—roll nip type using roll-like members for both a fixing rotation body and a pressurizing rotation body is applied as an example. Other components than the fuser are not limited in the invention and therefore in the embodiment, only a fuser 30 adopting the electromagnetic induction heating method will be discussed with reference to FIG. 7.

Figure 7:
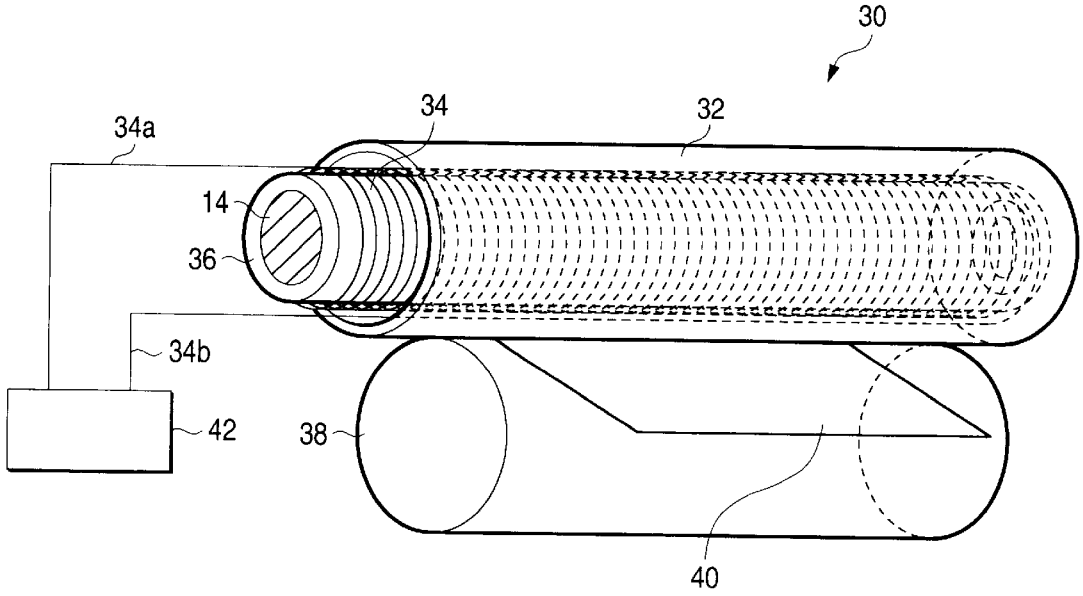
FIG. 7 is a schematic drawing to show only a portion of a fuser of an electrophotographic apparatus according to a third embodiment of the invention.

FIG. 7 is a schematic drawing to show the fuser 30 according to the embodiment. The fuser 30 comprises a heating roll (fixing rotation body) 32 formed of a magnetic metal (for example, iron) and an induction heating coil (magnetic field generation member) 34 being placed in the heating roll 32 for supplying heat energy thereto.

In the embodiment, a conductive layer for causing an eddy current to occur by electromagnetic induction for generating heat is the heating roll 32 itself formed of a magnetic metal. In the invention, it is indispensable to form a conductive layer in the proximity of the peripheral surface of the fixing rotation body. Another conductive layer may be formed on the peripheral surface of the base material as the fixing rotation body and on the other hand, the base material itself may form a conductive layer as in the embodiment. Of course, in any case, any other layer such as an elastic layer or a mold release layer may be further formed on the surface of the conductive layer. The conductive layer as another formed conductive layer and other layers are similar to those described in embodiments discussed later.

The base material does not contribute to heating and therefore is not limited and any of various plastic materials, metal, ceramic materials, glass materials, etc., can be used with no problem.

The expression "the proximity of the peripheral surface" defined in the invention is used to mean the proximity to such an extent that when the conductive layer generates heat by electromagnetic induction, even if another layer is formed on the peripheral surface, the heat propagates to the peripheral surface and the temperature of the peripheral surface can become a temperature sufficient for fixing (or transfer fixing) Therefore, the depth from the peripheral surface defining "the proximity of the peripheral surface" varies largely depending on various conditions, and a specific numeric value cannot be shown. When the base material itself may form a conductive layer and another layer is formed on the peripheral surface, the conductive layer is exposed. Also in this case, whether or not "the proximity of the peripheral surface" is applied is determined by focusing attention only on the state from the peripheral surface.

The induction heating coil 34 is held by an insulating bobbin 36, which is filled with magnetic particles 14 for enhancing and stabilizing the induction heating efficiency. In the embodiment, iron power carrier TSV-35 manufactured by Powdertech Co., Ltd. is used as the magnetic particles 14. The gap between the heating roll 32 and the induction heating coil 34 is made small (in the embodiment, 1.0 mm). On the other hand, the bobbin 36 is made thick (in the embodiment, 1.5 mm), so that the gap between the outer surface of the bobbin 36 and the magnetic particles 14 with which the bobbin 36 is filled is made large.

To form the induction heating coil 34, a wire material is wound helically from one end of the bobbin 36 and reaches an opposite end of the bobbin 36 to terminate the winding and then is passed through the gap between the heating roll 32 and the induction heating coil 34 to the winding start end side. Thus, an incoming end 34*a* of the winding start end of the wire material forming the induction heating coil 34 and an outgoing end 34*b* of the winding termination end are placed on the same side with respect to the heating roll 32.

The pressurizing roll 38 is pressed against the heating roll 32 and record paper (medium to be recorded) 40 on which an unfixed toner image is formed is inserted into a nip part formed between the pressurizing roll 38 and the heating roll 32 so that the side on which the unfixed toner image is formed comes in contact with the heating roll 32, whereby the toner image is fixed. The incoming end 34*a* and the outgoing end 34*b* of the induction heating coil 34 are connected to a high-frequency power supply 42 for supplying a high-frequency current to the induction heating coil 34. That is, the high-frequency power supply 42 is provided for supplying a high-frequency current to the induction heating coil 34.

Although not shown, the electrophotographic apparatus of the embodiment comprises an image formation unit having a transport roll for transporting record paper to the fuser, a photoconductor drum, a developing unit for forming an unfixed toner image on the photoconductor drum using electrophotography, a transfer unit for transferring the unfixed toner image formed on the photoconductor drum to record paper, and the like in addition to the fuser 30.

The operation of the fuser 30 according to the embodiment of the invention is as follows: When a switch (not shown) is operated, the high-frequency power supply 42 supplies a high-frequency current to the induction heating coil 34, which then generates a high-frequency magnetic field in response to the supplied high-frequency current. Accordingly, the heating roll 32 formed of a magnetic metal is placed in an alternating magnetic flux repeatedly produced and extinguished and thus an eddy current occurs so as to generate a magnetic field for preventing magnetic field change in the heating roll 32. The eddy current and electric resistance of the heating roll 32 cause Joule heat to occur, thereby heating the heating roll 32.

Thus, in the fuser 30 of the embodiment, the gap between the outer surface of the bobbin 36 and the magnetic particles 14 is made large and the induction heating coil 34 is wound around the bobbin 36, so that the gap between the heating roll 32 and the induction heating coil 34 can be lessened to enhance the electromagnetic induction heating efficiency to the induction heating coil.

Here, in the embodiment, in the fuser 30, the heat for fixing (Joule heat) is generated by supplying a high-frequency current to the induction heating coil 34. However, the outflow heat quantity varies depending on the part where the fuser 30 is fixed. That is, for the fuser 30 to fix an image on the record paper 40, the mechanism for fixing the fuser 30 to an outside is not positioned at a part with which the record paper 40 comes in contact in the heating roll 32. Therefore, the mechanism is positioned in the vicinity of both end parts of the bobbin 36 and heat outflow to the mechanism occurs. Thus, the generated Joule heat easily becomes nonuniform on the heating roll 32. Preferably, the Joule heat is generated uniformly.

Then, in the embodiment, a structure is provided for enabling the Joule heat to be generated almost uniformly by providing an amount distribution of the magnetic particles 14 stored in the bobbin 36.

Figure 8A:
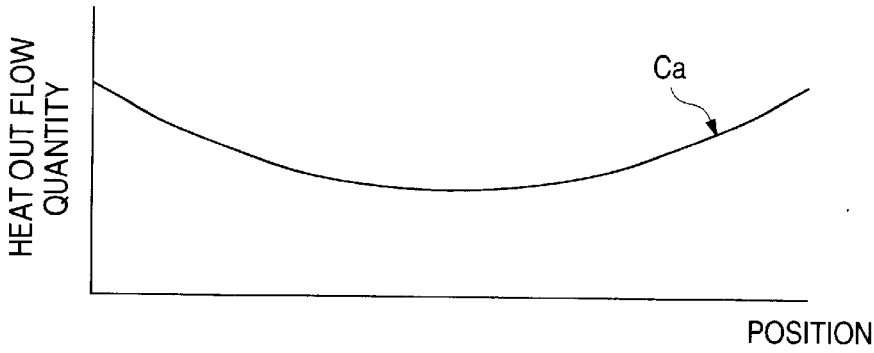
FIGS. 8A to 8D are characteristic drawings and structural drawings to show relationship between the heat outflow quantity and a distribution of magnetic particles in the fuser.

FIGS. 8A to 8D show relationship between the heat outflow quantity and a distribution of the magnetic particles 14 in the bobbin 36 of the fuser 30. FIG. 8A shows relationship between the position of the bobbin 36 in the axial direction thereof (namely, the left and right end parts in the graph correspond to the left and right end parts of the bobbin 36) and the heat outflow quantity. As seen in the figure, the heat outflow quantity increases as the position of the bobbin 36 is toward the left or right end part (characteristic Ca).

Figure 8B:
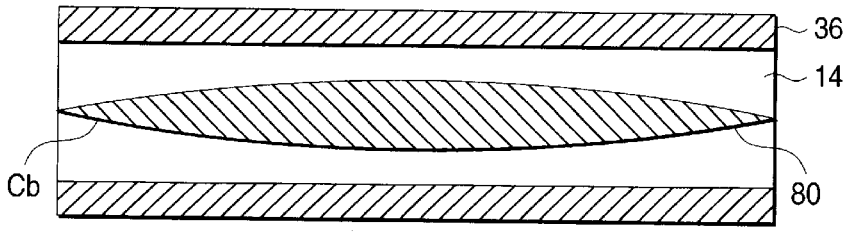

FIG. 8B shows an example of the structure for enabling the Joule heat to be generated almost uniformly in the axial direction of the bobbin 36. In FIG. 8B, an adjustment element 80 is provided for unevenly distributing the magnetic particles 14 in the bobbin 36. This adjustment element 80 has a rotation symmetrical shape and cross-sectional outer shape curve Cb of the adjustment element 80 is formed as a shape corresponding to the characteristic Ca (more precisely, the curvature of the curve of the characteristic Ca is roughly the same as the curvature of a curve provided when the cross-sectional area of the space in the bobbin 36 narrowed by the adjustment element 80 is graphed. In doing so, the amount distribution of the magnetic particles becomes the distribution in accordance with the characteristic Ca and the Joule heat can be generated almost uniformly in the axial direction of the bobbin 36.

The adjustment element 80 may be made of a nonmagnetic material or a magnetic material, because a material may be selected so as to produce a magnetic flux to make uniform the Joule heat provided as the whole of the bobbin 36. The case where the rotation symmetrical shape is adopted as an example has been described with reference to FIG. 8B, but the invention is not limited to it. That is, the adjustment element 80 may be formed so that the magnetic materials 14 increase in the vicinity of both end parts of the bobbin 36; for example, the adjustment element 80 may be formed so as to have at least one plane or a plurality of curved surfaces.

Figure 8C:
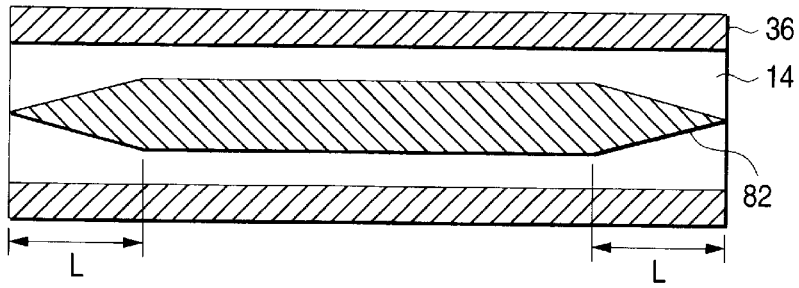

FIG. 8C shows another example of the structure for enabling the Joule heat to be generated almost uniformly in the axial direction of the bobbin 36. In FIG. 8B, it may be difficult to manufacture the adjustment element 80. Then, in FIG. 8C, in order to make it possible to easily manufacture the adjustment element, an adjustment element 82 provided by chamfering the vicinity of both end parts of a cylindrical shape is adopted. This adjustment element 82 is intended to change (increase) the distribution amount of the magnetic particles 14 in parts corresponding to the portions where the characteristic Ca appears most noticeably (areas each having a length L from either end part of the bobbin 36), thereby adjusting the distribution amount of the magnetic particles 14 in the most affected parts corresponding to the characteristic Ca.

Figure 8D:
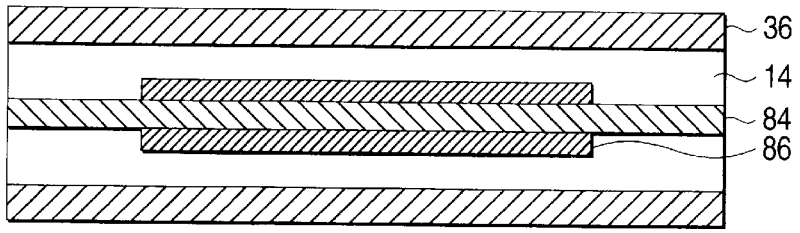

FIG. 8D shows another example of the structure for enabling the Joule heat to be generated almost uniformly. In FIG. 8C, the vicinity of the end pars of the adjustment element 82 must be worked and thus the flexibility is poor. In an example in FIG. 8D, adjustment elements 84 and 86 different in length are used and the cylindrical adjustment element 86 is placed surrounding the adjustment element 84. In doing so, adjustment elements for making it possible to change the storage amount of the magnetic particles 14 as desired can be easily formed simply by only changing the length of the adjustment element 84, 86.

Figure 9:
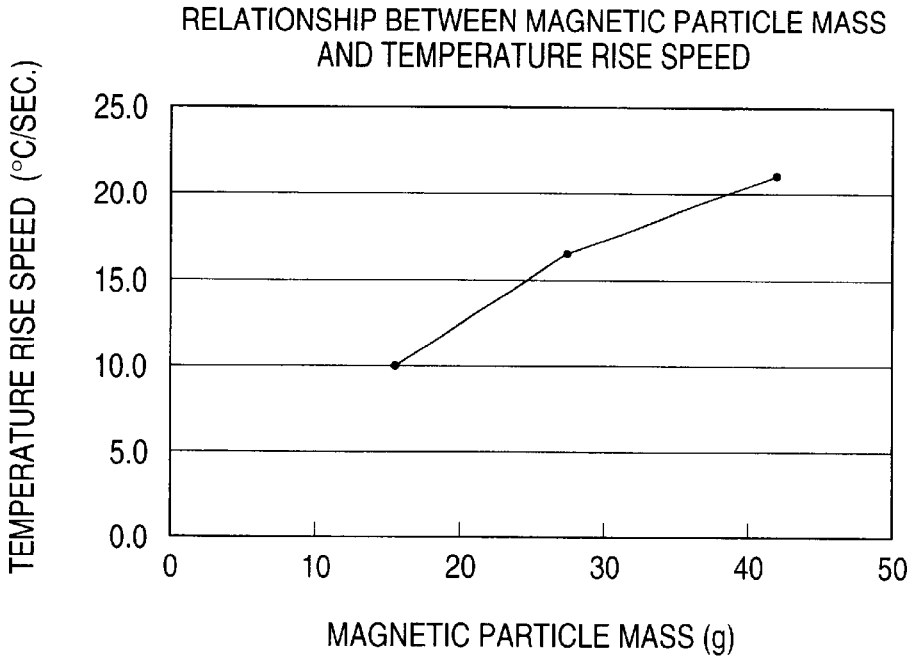
FIG. 9 is a characteristic drawing to show relationship between fluctuation in the storage amount of magnetic particles and temperature rise speed.

FIG. 9 shows relationship between fluctuation in the storage amount of the magnetic particles 14 and temperature rise speed. The test conditions at the time are as follows:

<Test Conditions>

The bobbin 36 was divided among three parts in the axial length and the three parts were filled with 15-g, 27-g, and 42-g magnetic particles respectively. Then, the roll temperature rise rate in each of the three parts was measured. The detailed conditions are as follows:

Magnetic particles: Iron power carrier TSV-35 manufactured by Powdertech Co., Ltd.

Bobbin: Made of polyphenylene sulfide, shaped like a cylinder having an inner diameter of 14 mm, an outer diameter of 17 mm, and a whole length of 350 mm Coil: Lead wire material: Copper, thickness: 2.5 mm, the number of turns: 125

Electric power: 1000-W output (25 kHz)

Heating roll: 26 mmϕ (outer diameter), steel (STKM13), length 400 mm

As seen in FIG. 9, the temperature raise speed also increases with an increase in the storage amount of the magnetic particles 14. Thus, it is understood that the shape of the bobbin 36 may be made so as to store such an amount of the magnetic particles 14 to generate a larger heat quantity at a place where the outflow heat is large, namely, to increase the temperature rise speed.

Thus, in the embodiment, magnetic particles are used as a magnetic material contributing to heat generated in the fuser, so that the magnetic core and furthermore, the magnetic field generation member can be easily molded or manufactured to any of various shapes. Therefore, the flexibility to design the fuser can be expanded.

In the embodiment, magnetic particles are used as a magnetic material contributing to heat generated in the fuser and the magnetic material is maintained in the particle state intact, so that occurrence of an eddy current in the magnetic core can be canceled and the heat loss of the eddy current can be canceled. That is, an electrophotographic apparatus of high energy efficiency can be provided.

[Fourth Embodiment]

Next, a fourth embodiment concerning an electrophotographic apparatus wherein a magnetic field shield member of the invention capable of providing a function for suppressing an electromagnetic field leakage from an electric machine is applied to electromagnetic shielding of a fuser will be discussed. The embodiment has an almost similar configuration to that of the above-described embodiments and therefore parts identical with those previously described are denoted by the same reference numerals and will not be discussed again in detail.

As descried above, generally an electrophotographic apparatus has an image formation unit for forming an unfixed toner image on the surface of a record medium using electrophotography and a fuser unit for fixing toner image on the surface of the record medium on which the unfixed toner image is formed. Also in the fourth embodiment, an example of using a fuser adopting the electromagnetic induction heating method as a fuser unit is shown although the configuration differs from that of the third embodiment.

In the fourth embodiment, as the fuser, a fuser of so-called roll—roll nip type using roll-like members for both a fixing rotation body and a pressurizing rotation body is applied as an example. Other components than the fuser are not limited in the invention and therefore in the embodiment, only a fuser 50 adopting the electromagnetic induction heating method will be discussed with reference to FIG. 10.

Figure 10:
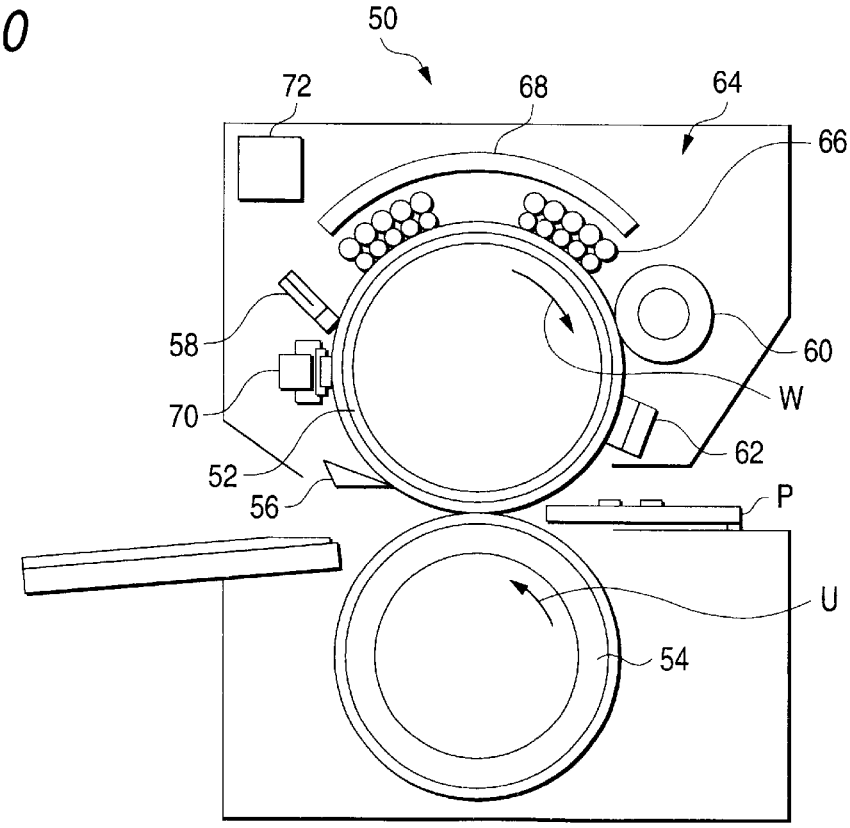
FIG. 10 is a schematic drawing to show only a portion of a fuser of an electrophotographic apparatus according to a fourth embodiment of the invention.

FIG. 10 is a schematic sectional view to show the general configuration of the fuser 50 according to the embodiment. The fuser 50 has a heating roll (fixing rotation body) 52 (40 mmϕ) and a pressurizing roll (pressurizing rotation body) 54 (40 mmϕ). The pressurizing roll 54 is pressed against the heating roll 52 by a pressurizing mechanism (not shown) to form a nip part so to have a constant nip width and the heating roll 52 is driven in a predetermined direction (an arrow W direction in FIG. 10) by a drive motor (not shown) to drive the pressurizing roll 54 to rotate in following manner in a predetermined direction (an arrow U direction in FIG. 10). The heating roll 52 is made of iron and has a thickness of 1 mm. The heating roll 52 is coated on the surface with a mold release layer of fluorine resin, etc. In the embodiment, iron is used as the roll material, but stainless steel, aluminum, a composite material of stainless steel and aluminum, or the like may be used.

The pressurizing roll 54 is formed by coating a cored bar coated on the periphery thereof with silicone rubber, fluorine rubber, or the like. Paper (record medium) P on which an unfixed toner image is formed passes through (is inserted into) the fixing point of the press contact part (nip part) between the heating roll 52 and the pressurizing roll 54, whereby the toner on the paper P is fused for fixing. At this time, of course, the paper P is inserted into the nip part so that the side on which the unfixed toner image is formed comes in contact with the heating roll 52.

The heating roll 52 is surrounded by a peeling claw 56 for peeling the paper P from the heating roll 52, a cleaning member 58 for removing foreign particle such as paper chips and toner offset on the surface of the heating roll 52, an induction heater 64 as magnetic field generation means, a mold release agent applicator 60 for applying a mold release agent for offset prevention, and a thermister 62 for detecting the temperature of the heating roll 52 in order in the downstream in the rotation direction from the contact position (nip part) between the heating roll 52 and the pressurizing roll 54.

The fuser uses the electromagnetic induction heating method of the induction heater 64 as the heating principle. The induction heater 64 has an excitation coil 66 and is placed on the outer peripheral surface of the heating roll 52. The excitation coil 66 uses copper wire rods each having a wire diameter of 0.5 mm and is configured as Litz wire having a bundle of wire rods insulated from each other. The excitation coil 66 is configured as Litz wire, whereby the wire diameter can be made smaller than osmosis depth to make it possible to allow an alternating current to flow effectively. In the embodiment, 16 wire rods each having a wire diameter of 0.5 mm are bundled. The coil is coated with heat resisting polyamide imide. The excitation coil 66 is placed in the proximity of the heating roll 52 in a state in which the excitation coil 66 is opposed to the surface of the heating roll 52, and functions as magnetic field generation member.

On the opposite side of the excitation coil 66 to the heating roll 52, a magnetic field shield member 68 is placed in the proximity of the excitation coil 66. The detailed operation of the magnetic field shield member 68 will be discussed later.

Also in the embodiment, the heating roll 52 is formed of magnetic metal and the heating roll 52 itself becomes a conductive layer for causing an eddy current to occur by electromagnetic induction to generate heat. Of course, as with the third embodiment, in the invention, another conductive layer may be formed and any other layer such as an elastic layer or a mold release layer may be further formed on the surface of the conductive layer.

The excitation coil 66 is connected to an excitation circuit (inverter circuit) 72 and a magnetic flux and an eddy current are caused to occur in the heating roll 52 formed of magnetic metal so as to hider change in a magnetic field by magnetic flux generated by a high-frequency current applied from the excitation circuit 72 to the excitation coil 66. Joule heat is generated by the eddy current and resistance of the heating roll 52 to heat the heating roll 52. In the embodiment, a high-frequency current of frequency 20 kHz and output 900 W is applied to the excitation coil 66. The surface temperature of the heating roll 52 is set to 180° C. and is controlled. The surface temperature is sensed by the thermister 62 and the heating roll 52 is heated by feedback control. At this time, in order to make a uniform temperature distribution of the whole roll, the heating roll 52 and the pressurizing roll 54 rotate. As the rolls are rotated, a constant heat quantity is given to the full face of each roll.

When the surface temperature of the heating roll 52 reaches 180° C., the image formation operation (so-called copy operation) is started and paper P on which an unfixed toner image is formed passes through the fixing point of the press contact part (nip part) between the heating roll 52 and the pressurizing roll 54, whereby the toner on the paper P is fused for fixing. Electric current to the excitation circuit 72 is supplied through a thermostat 70, which is a temperature fuse pressed against the surface of the heating roll 52. The allowable surface temperature of the heating roll 52 is preset in the thermostat 70 and when the surface temperature reaches an abnormal temperature exceeding the allowable temperature, the thermostat 70 shuts off the electric current supplied to the excitation circuit 72.

Figure 11:
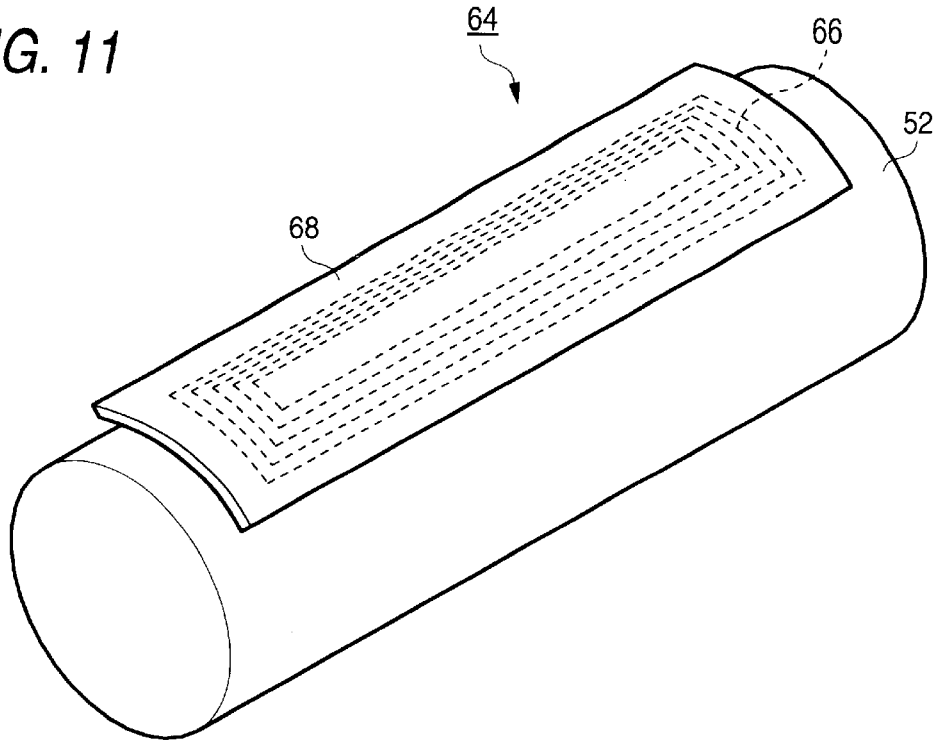
FIG. 11 is a perspective view to show positional relationship between a heating roll and a magnetic field generator in the fourth embodiment.

FIG. 11 is a perspective view to schematically show the heating roll 52 and the induction heater 64 (66+68) in the embodiment. As shown in FIG. 11, the excitation coil 66 (indicated by the dotted line in FIG. 11) is placed in a state in which the excitation coil 66 is opposed to the outer peripheral surface of the heating roll 52. The distance (gap) between the heating roll 52 and the excitation coil 66 is set to 1 mm. The excitation coil 66 is configured as an air-core coil and on the opposite side of the excitation coil 66 to the heating roll 52, the magnetic field shield member 68 is placed in the proximity of the excitation coil 66. The magnetic field shield member 68 is filled with ferrite powder as magnetic particles in a cover-like vessel placed in the proximity of the excitation coil 66 so as to cover the excitation coil 66.

In the embodiment, the distance (gap) between the excitation coil 66 and the magnetic field shield member 68 is set to 5 mm. The magnetic field shield member 68 is placed so that if the air-core coil (namely, the excitation coil 66) is placed in the proximity of the outer periphery of the heating roll 52, a magnetic field leaked to the outside (at least a part of a leakage magnetic field not affecting the heating roll 52 functioning as a conductive layer) is shielded. Thus, a problem of noise, etc., produced by electromagnetic field leakage can be eliminated. The magnetic field shield member 68 is placed, so that if the excitation coil 66 itself generates a magnetic field in any area other than the heating roll 52 side, no problem arises. Thus, a coil easily molded can be used as the excitation coil 66.

On the other hand, if the magnetic field shield member 68 does not exist and the induction heater 64 is placed in the proximity of the outer periphery of the heating roll 52, a core material (excitation coil 66) shaped so as to prevent a magnetic field from leaking to the outside of the fuser 50 must be used; the shape of the excitation coil 66 is limited or the core must be made a complicated shape. In the embodiment, the magnetic field shield member 68 may be placed separately in relation to the induction heater 64 and does not depend on the induction heater 64. Since the excitation coil 66 need not be made a complicated shape, an increase in cost is not incurred. In the embodiment, the case where the magnetic field shield member 68 has the curved surface shape corresponding to the circumferential surface has been described, but the shape is not limited to the curved surface shape and even if the shape is plain or any other shape, the shield effect can be produced.

The magnetic field shield member 68 is thus placed, so that if the excitation coil 66 is placed in the proximity of the outer periphery of the heating roll 52, a magnetic field is not leaked to the outside on the opposite side of the excitation coil 66 to the heating roll 52. Thus, the induction heater 64 need not be entered in the inside of the heating roll 52 to prevent the radiant heat in the heating roll 52 from causing the excitation coil 66 to be heated and degraded or the magnetic core to be heated and degraded to lower the heat efficiency.

In the embodiment, the case where ferrite powder is used as the magnetic particles in the magnetic field shield member 68 has been described, but a similar effect can be produced even if other magnetic particles than ferrite power are used. In the embodiment, the case where the distance between the magnetic field shield member 68 and the excitation coil 66 is set to 5 mm has been described, but evn if the magnetic field shield member 68 is brought into contact with the excitation coil 66, the effect of the invention can be produced, needless to say.

Since an aggregate of magnetic particles is used as the magnetic field shield member in the embodiment, the magnetic field shield member can be easily molded to any of various shapes and can be easily manufactured. Therefore, the performance of the fuser and furthermore the electromagnetic apparatus can be enhanced easily and at low cost without loosing miniaturization of the parts. Suppression of magnetic flux leakage is also demanded in various electric machines and the magnetic field shield member of the invention is applied to them, whereby the leakage magnetic flux density can be decreased easily and at low cost.

[Fifth Embodiment]

Next, a fifth embodiment concerning an electrophotographic apparatus wherein an inductance element using a magnetic core of the invention is used and a magnetic field shield member of the invention capable of providing a function for suppressing an electromagnetic field leakage is applied to electromagnetic shielding of a fuser will be discussed.

As descried above, generally an electrophotographic apparatus has an image formation unit for forming an unfixed toner image on the surface of a record medium using electrophotography and a fuser unit for fixing toner image on the surface of the record medium on which the unfixed toner image is formed. Also in the fifth embodiment, an example of using a fuser adopting the electromagnetic induction heating method as a fuser unit is shown although the configuration differs from that of the third or fourth embodiment.

In the fifth embodiment, as the fuser, a fuser of so-called belt-roll nip type using an endless belt member for a fixing rotation body and a roll-like member for a pressurizing rotation body is applied as an example. Other components than the fuser are not limited in the invention and therefore in the embodiment, only a fuser adopting the electromagnetic induction heating method will be discussed with reference to FIG. 12.

For the purposes of shortening the warm-up time and providing peeling performance of a record medium, the fuser in the embodiment uses a flexible endless belt member having a small heat capacity as a fixing rotation body, and the number of members taking heat is decreased as much as possible (the members are not disposed as much as possible) in the endless belt member. That is, in the endless belt member (heating belt), only a pad member (press member) having an elastic layer forming a fixing nip part is basically placed opposed to a pressuring member. The endless belt member to be heated is provided with a conductive layer and is induction heated by a magnetic field generated by a magnetic field generation member so that the endless belt member can be heated directly.

Figure 12:
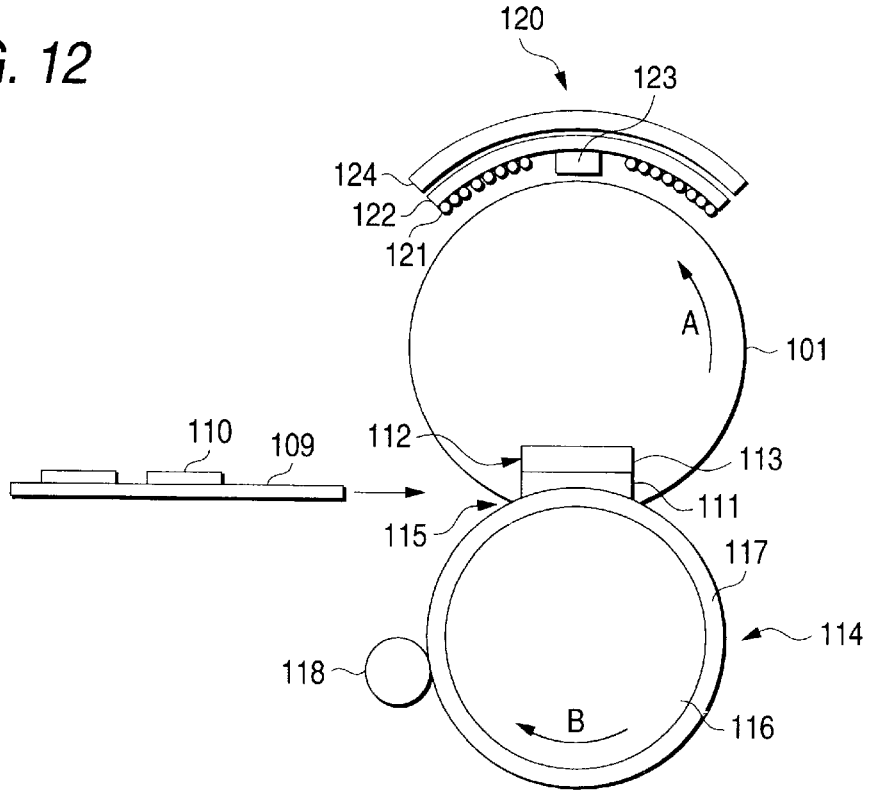
FIG. 12 is a schematic drawing to show only a portion of a fuser of an electrophotographic apparatus according to a fifth embodiment of the invention.

FIG. 12 is a schematic drawing to show the configuration of the fuser according to the embodiment.

In FIG. 12, numeral 101 denotes a heating belt as a fixing rotation body. The heating belt 101 has an endless belt having a conductive layer. Thus, in the invention, the "fixing rotation body" contains the endless belt member in addition to the roll-like member described above. The "pressurizing rotation body" also contains both the roll-like and endless belt members.

Figure 13:
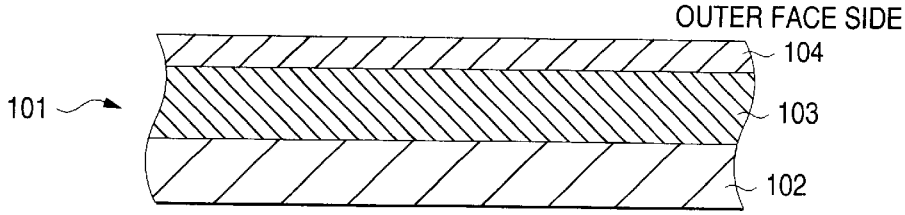
FIG. 13 is an enlarged sectional view to show a part of a heat belt used in the fuser in the fifth embodiment of the invention.

The heating belt 101 basically has at least three layers of a base material layer 102 made of a sheet member having a high heat resistance property, a conductive layer 103 deposited on the base material layer 102, and a surface mold release layer 104 as a top layer, as shown in FIG. 13. In the embodiment, an endless belt having a diameter of 30 mmϕ and having the three layers of the sheet-like base material layer 102, the conductive layer 103, and the surface mold release layer 104 is used as a heating belt 101.

Preferably, the base material layer 102 of the heating belt 101 is a sheet having a high heat resistance property, for example, 10 to 100 μm thick and more preferably 50 to 100 μm thick (for example, 75 μm); for example, a layer made of a synthetic resin having a high heat resistance property such as polyester, polyethylene terephthalate, polyether sulfone, polyether ketone, polysulfone, polyimide, polyimide amide, or polyamide can be named.

Figure 14:
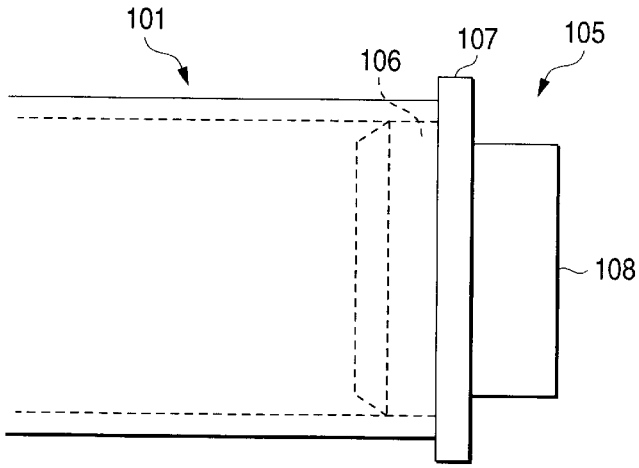
FIG. 14 is a structural drawing to show support structure of the heat belt used in the fuser in the fifth embodiment of the invention.

In the embodiment, both end parts of the heating belt 101 formed of an endless belt are abutted against an edge guide 105 to regulate meandering of the heating belt 101 for use, as shown in FIG. 14. FIG. 14 is an enlarged schematic representation to describe a state in which one end part opening of the heating belt 101 shaped like a pipe is abutted against the edge guide 105 to regulate meandering of the heating belt 101. The other end part opening of the heating belt 101 is also abutted against the similar edge guide (hereinafter, may be referred to as "a not-shown edge guide").

The edge guide 105 has a cylindrical part 106 having an outer diameter a little smaller than the inner diameter of the heating belt 101, a flange part 107 provided at an end part of the cylindrical part 106, and a hold part 108 formed in a cylindrical shape or a columnar shape and projected to the outside of the flange part 107. The edge guide 105 and the not-shown edge guide are disposed in a state in which both end parts of the heating belt 101 can slide and are fixed to the fuser so that a distance between the inner wall face of the flange part 107 and the inner wall face of a flange part at the not-shown edge guide against which the opposite end part opening of the heating belt 101 is abutted becomes a little longer than the length along the axial direction of the heating belt 101. Thus, the base material layer 102 of the heating belt 101 needs to have rigidity to such an extent that a circular form 30 mmϕ in diameter is held in any other portion than the nip part during rotation of the heating belt 101 (in the arrow A direction in FIG. 12) and that if the end part of the heating belt 101 is abutted against the edge guide 105, the heating belt 101 is prevented from buckling, etc.; for example, a sheet made of polyimide 50 μm thick is used as a base material 102.

The conductive layer 103 is a layer for induction heating by the electromagnetic induction action of a magnetic field generated by the magnetic field generation member described later; a metal layer of iron, cobalt, nickel, copper, chromium, etc., is formed about 1 to 50 μm thick for use as the conductive layer 103. In the embodiment, however, the heating belt 101 needs to follow the shape of the nip part formed by the pad described later and the pressurizing roll in the nip part and thus needs to be a flexible belt and preferably the conductive layer 103 is made thin as much as possible.

In the embodiment, as the conductive layer 103, an extremely thin layer of copper having high conductivity about 5 μm thick is evaporated onto the base material layer 102 made of polyimide so that the heating efficiency thereof becomes high.

Since the surface mold release layer 104 is a layer for coming in direct contact with an unfixed toner image 110 transferred onto paper 109 of a record medium, it is desirable that a material having a good mold release property should be used. As the material forming the surface mold release layer 104, for example, tetrafluoroethylene perfluoro alkyl vinyl ether copolymer (PFA), polytetrafluoroethylene (PTFE), silicone resin, a composite layer of them, or the like can be named. The surface mold release layer 104 is made of material appropriately selected from these materials and is provided with a thickness of 1 to 50 μm as the top layer of the heating belt 101. If the surface mold release layer 104 is too thin, durability is poor with respect to abrasive resistance and the life of the heating belt 101 is shortened; in contrast, if the surface mold release layer 104 is too thick, the heat capacity as the whole heating belt 101 is increased, prolonging the warm-up time. Therefore, both cases are not desirable.

In the embodiment, tetrafluoroethylene perfluoro alkyl vinyl ether copolymer (PFA) 10 μm thick is used as the surface mold release layer 104 of the heating belt 101 considering the balance between the abrasive resistance and the heat capacity as the whole heating belt 101.

For example, a pad member 112 as a press member having an elastic layer 111 of silicone rubber, etc., is placed in the described heating belt 101. In the embodiment, there is used one as the pad member 112, in which the elastic layer 111 made of silicone rubber with rubber hardness 350 (ISO 7619 Type A) is deposited on a support member 113 having rigidity, made of a metal of stainless steel, iron, etc., a synthetic resin having a high heat resistance property, or the like. For example, the elastic layer 111 made of silicone rubber is made uniformly thick for use. The support member 113 of the pad member 112 is placed in a state in which the support member 113 is fixed to a frame of the fuser (not shown), but may be pressed against the surface of a pressurizing roll 114 (described later) by an urging member such as a spring (not shown) so that the elastic layer 111 is brought into press contact with the surface of the pressurizing roll 114 by a predetermined press pressure.

The fuser has the pressurizing roll 114 as a pressuring rotation body placed in the portion opposed to the pad member 112 via the heat roll 101. A nip part 115 is formed with the heating belt 101 sandwiched between the pressurizing roll 114 and the pad member 112, and the paper 109 onto which the unfixed toner image 110 is transferred is passed through the nip part 115, whereby the unfixed toner image 110 is fixed onto the paper 109 by heat and pressure to form a fixed image.

In the embodiment, a pressuring roll provided by coating the surface of a solid iron roll 116 having a diameter of 26 mmϕ with tetrafluoroethylene perfluoro alkyl vinyl ether copolymer (PFA) 30 μm thick as a mold release layer 117 is used as the pressurizing roll 114.

The pressurizing roll 114 is provided with a metal roll 118 made of a metal such as aluminum or stainless steel having good thermal conductivity so that the metal roll 118 can contact with and detach from the pressurizing roll 114, as shown in FIG. 12. When the temperatures of the heating belt 101 and the pressurizing roll 114 are low in the early morning when energizing the fuser is started, etc., the metal roll 118 stops at a position away from the pressurizing roll 114. In the fuser, when a temperature difference along the axial direction occurs between the heating belt 101 and the pressurizing roll 114 as the fuser is used, for example, when fixing processing is consecutively performed for small-sized paper, the metal roll 118 is brought into contact with the pressurizing roll 114. When the metal roll 118 is in contact with the pressurizing roll 114, it is driven with rotation of the pressurizing roll 114. In the embodiment, a solid roll made of aluminum having a diameter of 10 mmϕ is used as the metal roll 118.

In the embodiment, the pressurizing roll 114 is rotated by a drive member (not shown) in a state in which it is pressed against the pad member 112 via the heating belt 101 by a pressurization member (not shown).

The heating belt 101, which is a fixing rotation body, is circulated with rotation of the pressurizing roll 114. Then, in the embodiment, to provide good slidability, a sheet material having strong abrasion resistance and good slidability, for example, a glass fiber sheet impregnated with fluorine resin (CHUKO KASEI KOGYO KK: FCF400-4, etc.,) is made to intervene between the heating belt 101 and the pad member 112 and further a mold release agent of silicone oil, etc., is applied to the inner face of the heating belt 101 as a lubricant for enhancing slidability. In doing so, at the actual heating time, the drive torque at the idling time of the pressurizing roll 114 can be decreased from about 6 kg cm to about 3 kg cm. Therefore, the heating belt 101 can be driven with rotation of the pressurizing roll 114 without slip and can be circulated at the speed equal to the rotation speed of the pressurizing roll 114 in the arrow B direction.

Motion of the heating belt 101 in an axial direction is regulated by the edge guide 105 and the not-shown edge guide at both end parts of the heating belt 101 in the axial direction, as shown in FIG. 14 to prevent meandering, etc., of the heating belt 101 from occurring.

In the embodiment, the thin heating belt having the conductive layer is induction heated by a magnetic field generated by the magnetic field generation member.

A magnetic field generation member 120 is a member formed long sideways in a direction orthogonal to the rotation direction of the heating belt 101 as a length direction and formed in a curve like, and is installed outside the heating belt 101 with a gap of about 0.5 mm to 2 mm held between the magnetic field generation member 120 and the heating belt 101. In the embodiment, the magnetic field generation member 120 comprises an excitation coil 121, a coil support member 122 for supporting the excitation coil 121, and a magnetic core 123 placed at the center of the excitation coil 121. A magnetic field shield member 124 is placed on the opposite side of the excitation coil 121 to the heating belt 101.

As the excitation coil 121, for example, a predetermined number of Litz wires each having a bundle of 16 copper wire rods insulated from each other and each having a diameter of 0.5 mmϕ are placed in parallel like a line.

Figure 15:
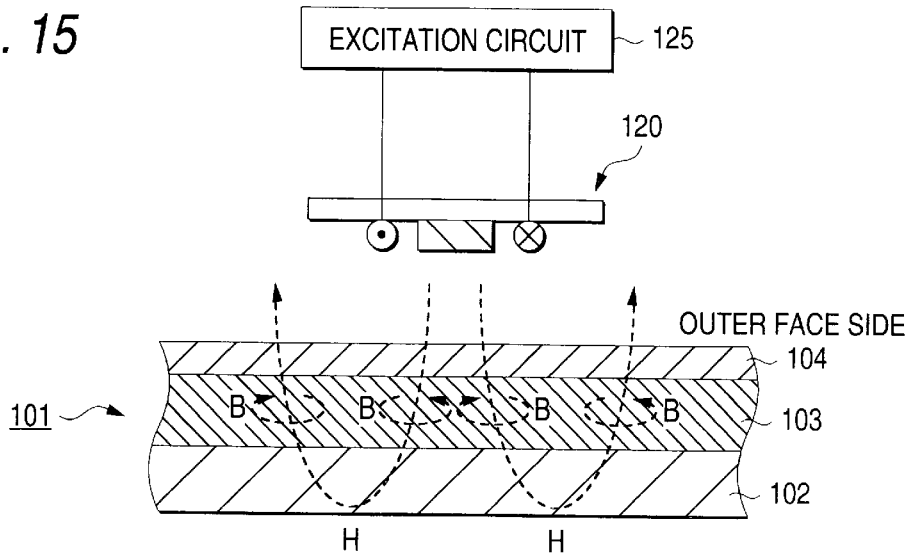
FIG. 15 is a schematic representation to show the heating principle of the heat belt used in the fuser in the fifth embodiment of the invention.

As shown in FIG. 15, an alternating current of a predetermined frequency is applied to the excitation coil 121 by an excitation circuit 125, whereby a fluctuating magnetic field H occurs in the surroundings of the excitation coil 121 and when the fluctuating magnetic field H crosses the conductive layer 103 of the heating belt 101, an eddy current B occurs in the conductive layer 103 of the heating belt 101 so as to generate a magnetic field hindering change in the magnetic field H by the electromagnetic induction action. The frequency of the alternating current applied to the excitation coil 121 is set in a range of 10 to 50 kHz, for example. In the embodiment, the frequency of the alternating current is set to 30 kHz. Then, the eddy current B flows through the conductive layer 103 of the heating belt 101, whereby Joule heat is generated by electric power proportional to the resistance of the conductive layer 103 ($W=IR^2$) to heat the heating belt 101, which is the fixing rotation body.

It is desirable that a heat resisting nonmagnetic material should be used as a coil support member 122; for example, heat resisting glass or a heat resisting resin of polycarbonate, etc., is used.

A magnetic core 123 of the magnetic core of the invention is placed at the center of the excitation coil 121. The magnetic core 123 is filled with magnetic particles in a vessel shaped like a rectangular parallelepiped. The vessel is similar to that described in the first embodiment except for the shape. The vessel is filled with magnetic particles, whereby the magnetic core becomes a magnetic core having an aggregate of magnetic particles having a rectangular parallelepiped as a whole in which the magnetic particles are maintained in the particle state. The details of the magnetic particles are also similar to those described in the first embodiment.

In the fifth embodiment, the aggregate of magnetic particles can be changed in volume and shape as desired because the magnetic particles are particulate, and the aggregate can be easily formed to the required size and shape. Therefore, the magnetic particles are used as the material of the magnetic core 123, so that the flexibility of design of the magnetic field generation member 120 is increased.

The magnetic particles are used, whereby the magnetic particle itself has adequate electric resistance and thus the self-heating problem caused by so-called induction heating is extremely small even in a high frequency band and therefore the loss is small and the effective magnetic permeability can be enhanced even in the high frequency band.

In the embodiment, the magnetic core 123 is provided, whereby a magnetic flux occurring in the excitation coil 121 can be gathered efficiently and the heating efficiency can be raised. Thus, it is made possible to lower the frequency of a high-frequency power supply for applying an alternating current to the excitation coil 121 and decrease the number of turns of the excitation coil 121, and the power supply and the excitation coil 121 can be miniaturized and the cost can be reduced.

On the other hand, in the embodiment, the magnetic field shield member 124 uses the magnetic field shield member of the invention. The magnetic field shield member 124 is provided to gather magnetic fluxes occurring in the excitation coil 121 to form a magnetic passage; the magnetic field shield member 124 makes it possible to heat with good efficiency and prevents a magnetic flux from leaking to the outside of the fuser and heating peripheral members unwillingly.

The magnetic field shield member 124 is filled with magnetic particles in a cover-like vessel placed in the proximity of the excitation coil 121 so as to cover the excitation coil 121. The specific configuration of the magnetic field shield member 124 is similar to that of the magnetic field shield member in the fourth embodiment.

Since an aggregate of magnetic particles is used as the magnetic field shield member in the embodiment, the magnetic field shield member can be easily molded to any of various shapes and can be easily manufactured. Therefore, the performance of the fuser, and furthermore the electrophotographic apparatus can be enhanced easily and at low cost without incurring miniaturization of the parts.

In the described configuration, the fuser in the embodiment makes it possible to set the warm-up time to almost zero, to provide a good fixing property, and reliably to prevent a peel failure from occurring as follows:

In the fuser in the embodiment, as shown in FIG. 12, the pressurizing roll 114 is rotated in the arrow B direction by a drive source (not shown) at process speed of 100 mm/s. The heating belt 101 press-contacts with the pressurizing roll 114 and is circulated at the speed 100 mm/s equal to the move speed of the pressurizing roll 114.

In the fuser, as shown in FIG. 12, the paper 109 on which the unfixed toner image 110 is formed by a transfer unit (not shown) is passed through the nip part 115 formed between the heating belt 101 and the pressurizing roll 114 so that the side of the paper 109 on which the unfixed toner image is formed comes in contact with the heating belt 101, and while the paper 109 is passed through the nip part 115, it is heated and pressurized by the heating belt 101 and the pressurizing roll 114, whereby the unfixed toner image 110 is fixed onto the paper 109 as a toner image.

At that time, in the fuser, the temperature of the heating belt 101 at the entrance of the nip part 115 is controlled at about 180° C. to 200° C. during the fixing operation time by the frequency of a high-frequency current allowed to flow into the excitation coil 121.

In the fuser in the embodiment, the pressurizing roll 114 starts to rotate and a high-frequency current is supplied to the excitation coil 121 at the same time as an image formation signal is input. For example, when 700 W electric power as effective electric power is input to the excitation coil 121, the heating belt 101 reaches a fixing-possible temperature in about two seconds from the room temperature by the induction heating action. That is, warm-up is complete within a time required for the paper 109 to move from a paper feed tray to the fuser. Therefore, the fuser can perform fixing processing without making the user wait.

If paper 109 (thin paper having about 60 gsm) onto which a large amount of toner such as a color solid image is transferred enters the nip part 115 of the fuser, usually the attraction force becomes strong between the toner and the surface mold release layer 104 of the heating belt 101 and it becomes hard to peel the paper 109 from the surface of the heating belt 101. In the embodiment, however, the shape of the heating belt 101 is convex outside the nip part 115 and is concave inside the nip part 115. That is, the paper 109 has a shape winding around the pressurizing roll 114 side inside the nip part 115 and the shape of the heating belt 101 changes rapidly from concave to convex at the exit of the nip part 115. Thus, the paper 109 cannot follow the rapid change in the shape of the heating belt 101 because of the firmness (rigidity) of the paper 109 itself, and is naturally peeled off from the heating belt 101. Therefore, in the fuser in the embodiment, a peel failure problem of the paper 109 can be reliably prevented from occurring.

If small-sized paper 109 is consecutively fixed, the temperatures of the heat belt 101, the pad member 112, the pressurizing roll 114, and the like in the area through which paper does not pass rise. However, the metal roll 118 placed on the side of the pressurizing roll 114 is brought into contact with the surface of the pressurizing roll 114, whereby the metal roll 118 can absorb the heat in the high-temperature part of the pressurizing roll 114 and moves the heat to the low-temperature part. Thus, the temperature difference (between a portion having high temperature and a portion having low temperature) in the axial direction becomes small and the temperature of the pressurizing roll 114 and the temperature of the heat belt 101 can be prevented from exceeding a predetermined temperature.

Further, the fuser has the elastic layer 111 on the hating belt 101 side in the nip part 115 so that the elastic layer 111 sandwiches the heating belt 101 having 65 $\mu$m thick, so that the effect of wrapping and fixing toner at the fixing time can be produced and good color image quality can be provided.

In order to provide better color image quality, an elastic layer made of silicone rubber, etc., having several 10 $\mu$m thick may be provided between the conductive layer 103 and the surface mold release layer 104 of the heating roll 101.

In the third to fifth embodiments, the examples of using either or both of the magnetic core or/and the magnetic field shield member of the invention with the fuser in the electrophotographic apparatus have been given. However, the electrophotographic apparatus of the invention is not limited to these example configurations and the configuration can be changed or added in various manners based on the known know-how so long as the configuration of the invention is contained.

For example, change can be made in such a manner that the pressurizing roll as the pressurizing rotation body in the third or fourth embodiment is changed to an endless belt pressurizing member (pressurizing belt) to form a roll-belt nip type fuser or that the pressurizing roll as the pressurizing rotation body in the fifth embodiment is changed to an endless belt pressurizing member (pressurizing belt) to form a belt—belt nip type fuser.

The configurations in the embodiments can also be used in combination as desired. For example, the metal roll placed for the pressurizing roll in the fifth embodiment can also be placed the pressurizing roll in the third or fourth embodiment.

Further, in the third to fifth embodiments, the configurations wherein only the fixing rotation body is heated are taken as examples. However, the pressurizing rotation body may be heated preliminarily. The heating method at this time may be heating with a heat source such as a general halogen lamp or may be the electromagnetic induction heating method. When adopting the electromagnetic induction heating method, of course, the magnetic core and the magnetic field shield member of the invention can be applied, in which case if the magnetic core or the magnetic field shield member of the invention is not applied to the fixing rotation body, the electrophotographic apparatus can be positioned as the electrophotographic apparatus of the invention.

In the embodiments, three examples wherein either or both of the magnetic core or/and the magnetic field shield member of the invention are placed are given. In the examples, the electrophotographic apparatus of the invention may has only either of the magnetic core or the magnetic field shield member of the invention, and placing both of the magnetic core and the magnetic field shield member of the invention is not required for the electrophotographic apparatus of the invention.

[Sixth Embodiment]

Last, a sixth embodiment concerning an electrophotographic apparatus adopting so-called transfer and fixing simultaneous technique wherein an inductance element adopting a magnetic core of the invention is used and a magnetic field shield member of the invention capable of providing a function for suppressing an electromagnetic field leakage is applied to electromagnetic shielding of a transfer and fuser unit will be discussed.

Figure 16:
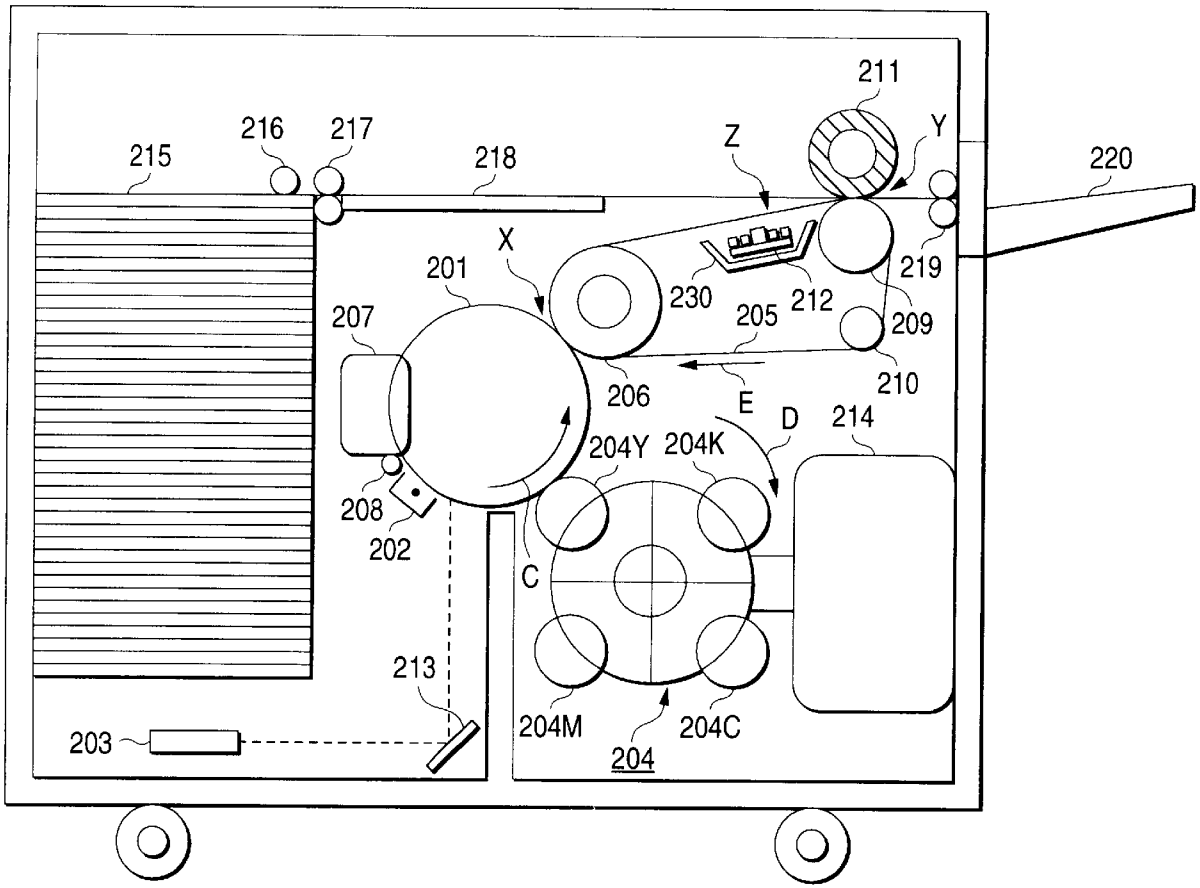
FIG. 16 is a schematic drawing to show configuration of an electrophotographic apparatus according to a sixth embodiment of the invention.

FIG. 16 is a schematic drawing to show the configuration an electrophotographic apparatus of the sixth embodiment of the invention.

The electrophotographic apparatus mainly has an image support rotation body, an image formation unit, a transfer and fixing section including a heating member and a pressurizing member.

In the embodiment, the image support rotation body is an intermediate transfer belt 205 having a circumferential surface on which an unfixed toner image is formed by the image formation unit and is taken up by a primary transfer roll 206, a tension roll 209, and a drive roll 210. In the embodiment, an endless belt body is used as the image support rotation body, but a roll-like body may be used.

The image formation unit has a photoconductive drum 201 having a surface on which a latent image is formed due to the electrostatic potential difference. Around the photoconductive drum 201, the image formation unit has a charger 202 for almost uniformly charging the surface of the photoconductive drum 201, a light exposure section having a laser scanner 203 for applying laser light responsive to each color signal to the photoconductive drum 201 to form a latent image, a mirror 213, etc., a rotation-type developing unit 204 storing four color toners of cyan, magenta, yellow, and black to visualize the latent image on the surface of the photoconductive drum 201 by the color toners to form an unfixed toner image, the above-mentioned primary transfer roll 206 disposed to face the photoconductive drum 201 while the intermediate transfer belt 205 is disposed therebetween, the primary transfer roll 206 for transferring the unfixed toner image on the surface of the photoconductive drum 201 to the intermediate transfer belt 205, a cleaning unit 207 for cleaning the surface of the photoconductive drum 201 after transfer, and an erasing lamp 208 for erasing the surface of the photoconductive drum 201.

The transfer and fixing section has the above-mentioned tension roll 209 disposed so as to take up the intermediate transfer belt 205 thereon together with the primary transfer roll 206 and the drive roll 210 and a pressurizing roll 211 of a pressurizing member disposed to face the tension roll 209 so as to sandwich the intermediate transfer belt 205 therebetween, and a nip part is formed between the intermediate transfer belt 205 and the pressurizing member.

The electrophotographic apparatus further has a paper feed roll 216 for transporting paper (record media) stored in a paper feed unit one sheet by one sheet at a time, a registration roll 217, and a transport guide 218 for supplying paper to the nip between the intermediate transfer belt 205 wound around the tension roll 209 and the pressurizing roll 211.

The electrophotographic apparatus of the embodiment of the invention is characterized by the fact that the electrophotographic apparatus has a magnetic field generation member 212 for heating the toner image from the back side of the intermediate transfer belt 205 and a magnetic field shield member 230 shaped so as to surround the magnetic field generation member 212, the magnetic field generation member 212 and the magnetic field shield member 230 disposed within the circumference of the intermediate transfer belt 205 and in the upstream in relation to the opposed position to the pressurizing roll 211 in the circumferential rotation direction (nip part).

The photoconductive drum 201 has an OPC (organic photoconductive layer) or a photoconductor layer made of a-Si, etc., on the surface of a cylindrical conductive base material electrically grounded. The developing unit 204 has four developing devices 204C, 204M, 204Y, and 204K storing cyan, magenta, yellow, and black toners, respectively, and is supported to be rotatable so that the developing devices can be opposed to the photoconductive drum 201. Each developing device contains a developing roll for forming a toner layer on the surface thereof and transporting the toner layer to the opposed position to the photoconductive drum 201. A voltage having 400 V of DC voltage superposed on a rectangular wave alternating voltage having an alternating voltage value $V_{p-p}$ of 2 kV and a frequency f of 2 kHz is applied to the developing roll and the toner is transferred to the latent image on the surface of the photoconductive drum 201 by the action of an electric field. The developing devices 204C, 204M, 204Y, and 204K are replenished with toners from a toner hopper 214.

The intermediate transfer belt 205 has at least a conductive layer and a surface mold release layer deposited in order on the surface of a base material layer. It is similar in detail to the heating belt 101 in the fifth embodiment and will not be discussed again in detail.

Since the intermediate transfer belt 205 is driven by the drive roll 210 and is circumferentially moved, the intermediate transfer belt 205 is moved at the same speed as the inserted record medium with rotation of the drive roll 210 at the press contact part between the intermediate transfer belt 205 and the pressurizing roll 211, namely the nip part. At this time, the nip width and the record medium move speed are set so that the time during which the record medium exists in the nip part (nip time) becomes in a range of from 10 ms to 50 ms or more. This nip time, namely, the time interval between the instant at which fused toner is pressed against the record medium and the instant at which the record medium is peeled off from the intermediate transfer belt 205 is not less than 50 ms as mentioned above, so that if the toner is heated to sufficient temperature to deposit the toner on the record medium, the toner temperature is lowered to such an extent that no offset occurs at the exit of the nip.

The magnetic field generation member 212 in the embodiment is formed like a line as a whole, while the magnetic field generation member 120 in the fifth embodiment is formed like a curve along the shape of the heating belt 101 placed in the proximity of the magnetic field generation member 120. However, they are the same except the shape. That is, as a magnetic core, the magnetic core of the invention is used. The detailed description is the same as that in the fifth embodiment and therefore will not be made again.

The heating principle of the magnetic field generation member 212 and the intermediate transfer belt 205 is also similar to that of the magnetic field generation member 120 and the heating belt 101 in the fifth embodiment.

In the sixth embodiment, the aggregate of magnetic particles can be changed in volume and shape as desired because the magnetic particles are particulate, and the aggregate can be easily formed to the required size and shape. Therefore, the magnetic particles are used as the material of the magnetic core of the magnetic field generation member 212, so that the flexibility of design of the magnetic field generation member 212 is increased.

The magnetic particles are used, whereby the magnetic particle itself has adequate electric resistance and thus the self-heating problem caused by so-called induction heating is extremely small even in a high frequency band and therefore the loss is small and the effective magnetic permeability can be enhanced even in the high frequency band.

The magnetic field shield member 230 in the embodiment is filled with magnetic particles in a cover-like vessel placed in the proximity of the magnetic field generation member 212 so as to cover the magnetic field generation member 212. In the embodiment, the magnetic field shield member 230 is like a ship shape in cross section so as to surround the magnetic field generation member 212. In other points, the specific configuration of the magnetic field shield member 230 is similar to that of the magnetic field shield member in the fourth embodiment.

Since an aggregate of magnetic particles is used as the magnetic field shield member in the embodiment, the magnetic field shield member can be easily molded to any of various shapes and can be easily manufactured. Therefore, the performance of the electrophotographic apparatus can be enhanced easily and at low cost without incurring miniaturization of the parts.

The operation of the described electrophotographic apparatus is as follows: The photoconductive drum 201 is rotated in the arrow C direction shown in FIG. 16 and is charged almost uniformly by the charger 202 and then is irradiated with laser light subjected to pulse width modulation in accordance with a yellow image signal of an original from the laser scanner 203 to form an electrostatic latent image corresponding to a yellow image on the photoconductive drum 201. The electrostatic latent image for the yellow image is developed by the yellow developing device 204Y previously placed at the developing position by the developing unit 204 to form a yellow unfixed toner image on the photoconductive drum 201.

The yellow unfixed toner image is electrostatically transferred by the action of the primary transfer roll 206 onto the circumferential surface of the intermediate transfer belt 205 circumferentially moving at the same line speed (process speed) as the rotation speed of the photoconductive drum 201 in the arrow C direction at a primary transfer part X, which is an abutment part between the photoconductive drum 201 and the intermediate transfer belt 205. The intermediate transfer belt 205 on which the yellow unfixed toner image is formed is once circumferentially moved in the opposite direction to the arrow C direction with the yellow unfixed toner image held on the surface of the intermediate transfer belt 205 and is placed at a position where a magenta image (next color image) is to be deposited on the yellow unfixed toner image for transfer.

On the other hand, after the surface of the photoconductive drum 201 is cleaned by the cleaning unit 207, the photoconductive drum 201 is again charged almost uniformly by the charger 202 and is irradiated with laser light from the laser scanner 203 in accordance with a magenta image signal.

While an electrostatic latent image for the magenta image is formed on the photoconductive drum 201, the developing unit 204 is rotated in the arrow D direction for placing the magenta developing device 204M at the developing position to develop the electrostatic latent image by magenta toner. A magenta unfixed toner image thus formed is electrostatically transferred onto the circumferential surface of the intermediate transfer belt 205 in the primary transfer part X and is deposited on the yellow unfixed toner image.

Subsequently, the described process is executed for cyan and black. At the termination of transferring and depositing four color toner images on the surface of the intermediate transfer belt 205 or while the last color (black) is being transferred, paper (record medium) stored in the paper feed unit 215 is fed by the paper feed roll 216 and is transported via the registration roll 217 and the transport guide 218 to a secondary transfer part Y of the intermediate transfer belt 205.

On the other hand, the four-color unfixed toner image formed on the circumferential surface of the intermediate transfer belt 205 is passed through a heating area Z opposed to the magnetic field generation member 212 in the upstream in relation to the secondary transfer part Y. In the heating area Z, the conductive layer of the intermediate transfer belt 205 heats upon electromagnetic induction heating by the action of a magnetic field generated by the magnetic field generation member 212. Accordingly, the conductive layer is rapidly heated and the heat is propagated to the surface mold release layer with the passage of time. When the unfixed toner image on the circumferential surface of the intermediate transfer belt 205 arrives at the secondary transfer part Y, the unfixed toner image on the circumferential surface of the intermediate transfer belt 205 is fused.

The toner of the unfixed toner image fused on the circumferential surface of the intermediate transfer belt 205 is brought into intimate contact with paper by pressure of the pressurizing roll 211, which presses in agreement with transporting of the paper in the secondary transfer part Y. In the heating area Z, the intermediate transfer belt 205 is heated locally only in the surface proximity and the fused toner comes in contact with the paper having the same temperature as the room temperature and is rapidly cooled. That is, when the fused toner passes through the nip part of the secondary transfer part Y, the fused toner instantaneously penetrates the paper and is transferred and fixed by the heat energy and the press contact force, which the toner has, and the paper is transported to the exit of the nip part while the paper is drawing the heat from the toner and the intermediate transfer belt 205 heated only in the surface proximity. At this time, the nip width and the record medium move speed are set appropriately, so that the temperature of the toner at the exit of the nip part becomes lower than the softening point temperature. Thus, the cohesive force of the toner grows and the toner image is almost completely transferred and fixed to the paper surface without producing offset. After this, the paper where the toner image is transferred and fixed is ejected through an ejection roll 219 onto an ejection tray 220. The full-color image formation is now complete.

As described above, in the electrophotographic apparatus of the invention, only the proximity of the conductive layer of the intermediate transfer belt 205 absorbing the electromagnetic wave is heated in the heating area Z opposed to the magnetic field generation member 212 and the toner heated and fused in the heating area Z is brought into press contact with the paper having the same temperature as the room temperature at the secondary transfer part Y, whereby the toner is fixed at the same as the toner is transferred. Since only the surface of the intermediate transfer belt 205 is heated, the temperature of the intermediate transfer belt 205 is lowered rapidly after the transfer and fixing. Thus, accumulation of heat in the electrophotographic apparatus is extremely lessened.

On the other hand, if the electrophotographic apparatus in the related art adopting the transfer and fixing simultaneous technique is used continuously, accumulation of heat occurs and a rise in the apparatus temperature accompanying the continuous use of the apparatus becomes noticeable and the potential characteristic of the photoconductive drum becomes unstable. Particularly, lowering the charge potential becomes noticeable and if reverse development is used, for example, as a toner image formation method, background fogging occurs in a background portion and degradation of the image quality becomes noticeable. As the apparatus temperature rises, a phenomenon in which toner is fused in the vicinity of the developing unit and is firmly fixed onto a cleaning blade, etc., is also observed. In contrast, when the electrophotographic apparatus of the embodiment is used continuously, the rise in the apparatus temperature is smaller by far than that in the apparatus in the related art, and the characteristics of the photoconductive drum, toner, etc., do not change. Thus, to use the apparatus for a long time, the image quality degradation is scarcely observed and high-quality images can be provided stably. Particularly, this advantage is noticeable to form a color image.

Accordingly, the electrophotographic apparatus of the embodiment has the following specific advantages: Since the proximity of the surface of the intermediate transfer belt is directly heated by the magnetic field generation member, rapid heating can be accomplished independently of the thermal conductivity or the heat capacity of the base material of the intermediate transfer belt. Since the transfer efficiency does not depend on the thickness of the intermediate transfer belt, when the rigidity of the intermediate transfer belt needs to be enhanced to speed up, even if the base layer (base material) of the intermediate transfer belt is thickened, the toner can be promptly heated to the fixing temperature.

The base layer of the intermediate transfer belt generally has a resin having low thermal conductivity and thus is good in heat insulation and if continuous print is executed, the heat loss is small. If an area in which no image exists, for example, a non-image area between continuously fed paper sheets is passed through the heating area Z, the excitation circuit can also be controlled to stop fruitless heating. Accordingly, the energy efficiency becomes very high. As the heat efficiency is enhanced, the temperature rise in the electrophotographic apparatus can also be suppressed accordingly and the characteristic change of the photoconductive drum, firm fixing of toner onto the cleaning member, etc., can also be prevented.

Incidentally, in the embodiment, the example is shown wherein after all four color unfixed toner images are transferred to the circumferential surface of the intermediate transfer belt, the electromagnetic induction heating is executed by the magnetic field generation member to heat and fuse the toner. However, after one color toner image is primarily transferred at a time, the toner may be heated and fused and be temporarily fixed onto the circumferential surface of the intermediate transfer belt. Such a method makes it possible to prevent disordering of four color superposed toner images and match the images in registration and magnification with good accuracy.

In the embodiment, the electrostatic transfer method using a bias application roll having an insulating dielectric layer for electrostatically transferring the unfixed toner image onto the intermediate transfer belt is adopted as the transfer method in the primary transfer part X. However, adhesion transfer in which a heat resisting intermediate transfer belt having elasticity is provided and a primary transfer roll presses against a photoconductive drum from the inside of the intermediate transfer belt to transfer an unfixed toner image onto the circumferential surface of the intermediate transfer belt may be adopted. At the time, toner is a little left on the surface of the photoconductive drum after the transfer and thus it is desirable that the remaining toner should be erased and cleaned by an electricity erasing unit and a cleaning unit.

In the sixth embodiment, the example of using the magnetic core and the magnetic field shield member of the invention with the fuser in the electrophotographic apparatus has been given. However, the electrophotographic apparatus of the invention is not limited to the configuration in the embodiment and the configuration can be changed or added in various manners based on the known know-how so long as the configuration of the invention is contained.

For example, in the embodiment, the intermediate transfer belt having the endless belt like is used. However, a roll-like intermediate transfer roll or a photoconductor (roll-like or endless belt photoconductor) may be used as the image support rotation body. When using the image support rotation body as a photoconductor, the above-described developing devices correspond to the image formation unit in the invention. However, since the photoconductor itself is heated by electromagnetic induction heating, the photoconductor and the image formation system both having the heat resistance are required.

In the embodiment, the intermediate transfer belt 205 is heated only by electromagnetic induction heating in the heating area Z, but the tension roll 209 may be a heating member as a heating source for auxiliarily or mainly transferring and fixing. In this case, if heating of the tension roll 209 has a sufficient heat quantity as the heating source for transferring and fixing, the electromagnetic induction heating in the heating area Z may be skipped. As the heating method of the tension roll 209, a heat source such as a halogen lamp known as a fixing roll is placed in the tension roll 209 or the electromagnetic induction heating technique may be adopted as with the heating roll in the third or fourth embodiment. In this case, of course, either or both the magnetic core or/and the magnetic field shield member of the invention can be used.

Each of the configurations shown in the third to fifth embodiments can also be incorpolated to the sixth embodiment whenever necessary.

In the sixth embodiment, the example wherein both of the magnetic core and the magnetic field shield member of the invention are placed is given. The electrophotographic apparatus of the invention may has only either of the magnetic core or the magnetic field shield member of the invention, and placing both of the magnetic core and the magnetic field shield member of the invention is not required for the electrophotographic apparatus of the invention.

As described above, in the first to sixth embodiments, the volume and shape of a member on which electromagnetism acts can be changed as desired using magnetic particles as the member on which electromagnetism acts, so that the member can be easily formed to the required size.

While the first to sixth embodiments of the invention have been described, such description is for illustrative purposes only, and it is to be understood that the dimensions, the shapes, the placement, the characteristics, the compositions, the conditions, etc., (including the specific numeric values thereof) specified in the apparatus configurations do not limit the invention and that those skilled in the art can appropriately select the optimum ones in response to various conditions.

As described above, according to the invention, an aggregate of magnetic particles is used as the magnetic core, whereby the magnetic core can be easily molded to any of various shapes and can be easily manufactured and is only installed in a part of an inductance element such as a coil or a transformer, so that the inductance can be flexibly designed over a wide range. Further, the loss is small and the effective magnetic permeability can be enhanced even in a high frequency band.

According to the invention, the magnetic particles are adopted as the magnetic core material and the magnetic material is maintained intact in the particle state, so that occurrence of the eddy current in the magnetic core can be canceled. Thus, the heat loss of the eddy current can be canceled.

Further, the magnetic field shield member of the invention made of an aggregate of magnetic particles is installed surrounding the magnetic field generation member for generating a magnetic field, whereby electromagnetic field leakage can be suppressed and because the magnetic particles are particulate, the shape can be worked as desired and the flexibility of parts design can be enhanced.

On the other hand, according to the invention, in the electrophotographic apparatus adopting the electromagnetic induction heating technique for fuser unit or transferring and fuser unit, the magnetic core suppressing the eddy current loss and having high flexibility in shape is used in the magnetic field generation member, so that still more energy saving can be accomplished at low cost, the flexibility in designing the electrophotographic apparatus can be expanded, and further the electrophotographic apparatus can be still more miniaturized.

According to the invention, in the electrophotographic apparatus adopting the electromagnetic induction heating technique for fuser unit or transferring and fuser unit, magnetic field leakage from the magnetic field generation member can be shielded effectively.

What is claimed is:

1. A magnetic core comprising:

a magnetic field generation member for supplying magnetic field;

a vessel; and magnetic particles, wherein the magnetic particles form an aggregate; and wherein the aggregate of the magnetic particles is disposed in the vessel while the magnetic particles are keeping a particle state.

2. The magnetic core according to claim 1, wherein the magnetic field generation member is one of a coil and a transformer.

3. The magnetic core according to claim 1, wherein the magnetic particle comprises at least one of iron powder, ferrite powder, and magnetite powder.

4. The magnetic core according to claim 1, wherein the vessel has a shape responsive to the temperature characteristic produced by electromagnetism acting on the magnetic particles.

5. The magnetic core according to claim 1 wherein the vessel comprises a nonmagnetic material.

6. The magnetic core according to claim 1, wherein the vessel has a lid to allow the magnetic particles to be inserted into and removed from the vessel; and wherein the lid seals the vessel.

7. The magnetic core according to claim 4, wherein an adjustment element for adjusting a filling amount of the magnetic particle is contained in the vessel.

8. The magnetic core according to claim 7, wherein the adjustment element is a magnetic substance in a solid state.

9. The magnetic core according to claim 7, wherein the adjustment element is a nonmagnetic material in a solid state.

10. A magnetic field shield member for shielding a magnetic field, comprising:

a magnetic field generation member for supplying magnetic field;

a vessel; and magnetic particles, wherein the magnetic particles form an aggregate; and wherein the aggregate of the magnetic particles is disposed in the vessel while the magnetic particles are keeping a particle state.

11. The magnetic core according to claim 10, wherein the magnetic field generation member is one of a coil and a transformer.

12. The magnetic field shield member according to claim 10, wherein the magnetic particle comprises at least one of iron powder, ferrite powder, and magnetite powder.

13. The magnetic field shield member according to claim 10, wherein the vessel has a lid to allow the magnetic particles to be inserted into and removed from the vessel; and wherein the lid seals the vessel.

14. An electrophotographic apparatus comprising:

an image formation unit for forming an unfixed toner image on a surface of a record medium by using electrophotography;

a fuser unit having a fixing rotation body and a pressurizing rotation body disposed to press against the fixing rotation body to define a nip part therebetween; and a magnetic field generation member for generating magnetic field, wherein the record medium is inserted into the nip part so that a surface of the record medium on which the unfixed toner image is formed contacts with the fixing rotation body, whereby the fuser unit fixes the unfixed toner image on the surface of the record medium;

wherein a conductive layer is formed in the proximity of the circumferential surface of one of the fixing rotation body and the pressurizing rotation body;

wherein the magnetic field generation member is placed close to the one of the fixing rotation body and the pressurizing rotation body;

wherein the magnetic field generation member has a magnetic core comprising:

a first vessel; and first magnetic particles, wherein the first magnetic particles form an aggregate; and wherein the aggregate of the first magnetic particles is disposed in the first vessel while the magnetic particles are keeping a particle state.

15. The electrophotographic apparatus according to claim 14, wherein each of the fixing rotation body and the pressurizing rotation body is formed in one of a roll and an endless belt.

16. The electrophotographic apparatus according to claim 14, further comprising a leakage magnetic field shielding member for shielding at least a part of a leakage magnetic field, which does not affect the conductive layer, of the magnetic field generated from the magnetic field generation member, wherein the leakage magnetic field shielding member is disposed in the periphery of the magnetic field generation member;

wherein the leakage magnetic field shielding member comprises:

a second vessel; and second magnetic particles, wherein the second magnetic particles form an aggregate; and wherein the aggregate of the second magnetic particles is disposed in the second vessel while the second magnetic particles are keeping a particle state.

17. An electrophotographic apparatus comprising:

an image support rotation body;

an image formation unit for forming an unfixed toner image on a circumferential surface of the image support rotation body by using electrophotography;

a pressurizing member disposed to face the image support rotation body to define a nip part therebetween; and a magnetic field generation member for generating a magnetic field, wherein a record medium is inserted into the nip part, whereby the unfixed toner image is transferred and fixed onto a surface of the record medium by heat and pressure;

wherein a conductive layer is formed in the proximity of the circumferential surface of the image support rotation body;

wherein the magnetic field generation member is disposed close to the image support rotation body and at one of the nip part of the image support rotation body and a place which is in the upstream in relation to the nip part;

wherein the magnetic field generation member comprises a magnetic core having:
a first vessel; and
first magnetic particles, wherein the first magnetic particles form an aggregate; and wherein the aggregate of the first magnetic particles is disposed in the first vessel while the first magnetic particles are keeping a particle state.

18. The electrophotographic apparatus according to claim 17, wherein the image support rotation body is formed in one of a roll and an endless belt.

19. The electrophotographic apparatus according to claim 17, further comprising a leakage magnetic field shielding member for shielding at least a part of a leakage magnetic field, which does not affect the conductive layer, of the magnetic field generated from the magnetic field generation member, wherein the leakage magnetic field shielding member is disposed in the periphery of the magnetic field generation member;

wherein the leakage magnetic field shielding member comprises:
a second vessel; and
second magnetic particles, wherein the second magnetic particles form an aggregate; and wherein the aggregate of the second magnetic particles is disposed in the second vessel while the second magnetic particles are keeping a particle state.

20. An electrophotographic apparatus comprising:

an image support rotation body;

an image formation unit for forming an unfixed toner image on a circumferential surface of the image support rotation body by using electrophotography;

a heating member disposed in the image support rotation body to abut against the image support rotation body;

a pressurizing member disposed to face the heating member through the image support rotation body to define a nip part between the pressurizing member and the image support rotation body; and a magnetic field generation member for generating a magnetic field, wherein a record medium is inserted into the nip part, whereby the unfixed toner image is transferred and fixed onto a surface of the record medium by heat and pressure;

wherein a conductive layer is formed at one of a place which is in the proximity of the circumferential surface of the image support rotation body and another place which is in the proximity of an abutment part of the heating member against the image support rotation body;

wherein when the conductive layer is formed in the image support rotation body is formed, the magnetic field generation member is disposed close to one of the nip part of the image support rotation body and a place on the image support member in the upstream in relation to the nip part;

wherein when the conductive layer is formed in the heating member, the magnetic field generation member is disposed close to the heating member;

wherein the magnetic field generation member comprises a magnetic core having:
a first vessel; and
first magnetic particles, wherein the first magnetic particles form an aggregate; and wherein the aggregate of the first magnetic particles is disposed in the first vessel while the first magnetic particles are keeping a particle state.

21. The electrophotographic apparatus according to claim 20, wherein the image support rotation body is formed in one of a roll and an endless belt.

22. The electrophotographic apparatus according to claim 20, further comprising a leakage magnetic field shielding member for shielding at least a part of a leakage magnetic field, which does not affect the conductive layer, of the magnetic field generated from the magnetic field generation member, wherein the leakage magnetic field shielding member is disposed in the periphery of the magnetic field generation member;

wherein the leakage magnetic field shielding member comprises:
a second vessel; and
second magnetic particles, wherein the second magnetic particles form an aggregate; and wherein the aggregate of the second magnetic particles is disposed in the second vessel while the second magnetic particles are keeping a particle state.

23. An electrophotographic apparatus comprising:

an image formation unit for forming an unfixed toner image on a surface of a record medium by using electrophotography;

a fuser unit having a fixing rotation body and a pressurizing rotation body disposed to abut against the fixing rotation body to define a nip part therebetween;

a magnetic field generation member for generating a magnetic field;

a conductive layer formed in the proximity of the circumferential surface of one of the fixing rotation body and the pressurizing rotation body; and a leakage magnetic field shielding member for shielding at least a part of a leakage magnetic field, which does not affect the conductive layer, of the magnetic field generated from the magnetic field generation member, wherein the record medium is inserted into the nip part so that a surface of the record medium on which the unfixed toner image is formed contacts with the fixing rotation body, whereby the fuser unit fixes the unfixed toner image on the surface of the record medium;

wherein the magnetic field generation member is placed close to the one of the fixing rotation body and the pressurizing rotation body;

wherein the leakage magnetic field shielding member is disposed in the periphery of the magnetic field generation member;

wherein the magnetic field shield member having:
a vessel; and
magnetic particles, wherein the magnetic particles form an aggregate; and wherein the aggregate of the magnetic particles is disposed in the vessel while the magnetic particles are keeping a particle state.

24. The electrophotographic apparatus according to claim 23, wherein each of the fixing rotation body and the pressurizing rotation body is formed in one of a roll and an endless belt.

25. An electrophotographic apparatus comprising:

an image support rotation body;

an image formation unit for forming an unfixed toner image on a circumferential surface of the image support rotation body by using electrophotography;

a pressurizing member disposed to face the image support rotation body to define a nip part therebetween;

a magnetic field generation member for generating a magnetic field;

a conductive layer formed in the proximity of the circumferential surface of the image support rotation body; and a leakage magnetic field shielding member for shielding at least a part of a leakage magnetic field, which does not affect the conductive layer, of the magnetic field generated from the magnetic field generation member, wherein a record medium is inserted into the nip part, whereby the unfixed toner image is transferred and fixed onto a surface of the record medium by heat and pressure;

wherein the magnetic field generation member is disposed close to the image support rotation body and at one of the nip part of the image support rotation body and a place which is in the upstream in relation to the nip part;

the magnetic field shield member having:

a vessel; and magnetic particles, wherein the magnetic particles form an aggregate; and wherein the aggregate of the magnetic particles is disposed in the vessel while the magnetic particles are keeping a particle state.

26. The electrophotographic apparatus according to claim 25, wherein the image support rotation body is formed in one of a roll and an endless belt.

27. An electrophotographic apparatus comprising:

an image support rotation body;

an image formation unit for forming an unfixed toner image on a circumferential surface of the image support rotation body by using electrophotography;

a heating member disposed in the image support rotation body to abut against the image support rotation body;

a pressurizing member disposed to face the heating member through the image support rotation body to define a nip part between the pressurizing member and the image support rotation body;

a magnetic field generation member for generating a magnetic field, a conductive layer formed at one of a place which is in the proximity of the circumferential surface of the image support rotation body and another place which is in the proximity of an abutment part of the heating member against the image support rotation body;

a leakage magnetic field shielding member for shielding at least a part of a leakage magnetic field, which does not affect the conductive layer, of the magnetic field generated from the magnetic field generation member, wherein a record medium is inserted into the nip part, whereby the unfixed toner image is transferred and fixed onto a surface of the record medium by heat and pressure;

wherein when the conductive layer is formed in the image support rotation body is formed, the magnetic field generation member is disposed close to one of the nip part of the image support rotation body and a place on the image support member in the upstream in relation to the nip part;

wherein when the conductive layer is formed in the heating member, the magnetic field generation member is disposed close to the heating member;

the magnetic field shield member having:

a vessel; and magnetic particles, wherein the magnetic particles form an aggregate; and wherein the aggregate of the magnetic particles is disposed in the vessel while the magnetic particles are keeping a particle state.

28. The electrophotographic apparatus according to claim 27, wherein the image support rotation body is formed in one of a roll and an endless belt.

* * * * *